US010023458B2

(12) United States Patent
Clever et al.

(10) Patent No.: US 10,023,458 B2
(45) Date of Patent: Jul. 17, 2018

(54) HOLD-OPEN LATCH ASSEMBLY FOR DISPENSING DEVICE

(71) Applicants: Bryan William Clever, Liberty Township, OH (US); Brenton Tyler Hershner, West Chester, OH (US)

(72) Inventors: Bryan William Clever, Liberty Township, OH (US); Brenton Tyler Hershner, West Chester, OH (US)

(73) Assignee: OPW FUELING COMPONENTS, LLC, Hamilton, OH (US)

( * ) Notice: Subject to any disclaimer, the term of this patent is extended or adjusted under 35 U.S.C. 154(b) by 9 days.

(21) Appl. No.: 15/169,136

(22) Filed: May 31, 2016

(65) Prior Publication Data

US 2016/0347602 A1 Dec. 1, 2016

Related U.S. Application Data

(60) Provisional application No. 62/168,416, filed on May 29, 2015.

(51) Int. Cl.
*B67D 7/42* (2010.01)
*B67D 7/04* (2010.01)
(Continued)

(52) U.S. Cl.
CPC ..... *B67D 7/42* (2013.01); *B67D 7/04* (2013.01); *F17C 1/00* (2013.01); *F17C 13/00* (2013.01);
(Continued)

(58) Field of Classification Search
USPC ..... 141/392
See application file for complete search history.

(56) References Cited

U.S. PATENT DOCUMENTS 3,807,603 A * 4/1974 Kisor ..... B67D 7/42 222/74
3,938,565 A * 2/1976 Robinson, Jr. ..... B67D 7/50 141/392
(Continued)

FOREIGN PATENT DOCUMENTS

EP 1669663 10/2005

OTHER PUBLICATIONS

Product information featuring "Staubli LPG Refuel Connectors" by Techspan Plastics & Printing Technologies (as early as Jan. 21, 2015).

(Continued)

*Primary Examiner* — Timothy L Maust
*Assistant Examiner* — Andrew Schmid
(74) *Attorney, Agent, or Firm* — Thompson Hine LLP

(57) ABSTRACT

A nozzle system including a nozzle body configured to dispense fluid therethrough and a lever coupled to the nozzle body and movable in a lever plane between a non-operating position and an operating position. The nozzle system further includes a latch assembly having an engagement surface and a cam. The cam is coupled to or positioned on one of the nozzle body or the lever, and the engagement surface is coupled to or positioned on the other one of the nozzle body or the lever. The nozzle system is configured such that when the lever is moved from the non-operating position to the operating position, the engagement surface engages the cam to cause at least one of the engagement surface or the cam to move relative to the other such that the lever is automatically retainable in the operating position by the latch assembly. The cam does not pivot about an axis aligned with the lever plane when the lever is moved from one of the non-operating position or the operating position to the other one of the non-operating position or the operating position.

27 Claims, 19 Drawing Sheets

(51) Int. Cl.
*F17C 1/00* (2006.01)
*F17C 13/00* (2006.01)

(52) U.S. Cl.
CPC ..... *F17C 2205/0376* (2013.01); *F17C 2221/035* (2013.01); *F17C 2223/0123* (2013.01); *F17C 2223/0153* (2013.01); *F17C 2265/065* (2013.01)

(56) References Cited

U.S. PATENT DOCUMENTS 4,098,488 A * 7/1978 Forrest ..... B67D 7/46 141/218
4,714,235 A 12/1987 Brown et al.
5,067,533 A * 11/1991 Carder, Sr. ..... B67D 7/48 141/206
5,307,848 A * 5/1994 Murray ..... B67D 7/0476 141/206
5,327,949 A * 7/1994 Dotson ..... B67D 7/42 141/206
5,549,132 A * 8/1996 Butterfield ..... B67D 7/42 137/270
5,670,762 A 9/1997 Futamura
6,572,392 B2 6/2003 Motojima
6,951,229 B2 * 10/2005 Garrison ..... B67D 7/44 141/206
6,962,177 B1 * 11/2005 McCommons ..... B67D 7/064 141/383
7,040,358 B2 * 5/2006 Lacroix ..... B67D 7/42 141/206
7,134,580 B2 * 11/2006 Garrison ..... B67D 7/48 141/392
8,033,305 B2 * 10/2011 Weh ..... F17C 13/00 141/206
8,167,003 B1 * 5/2012 Clever ..... B67D 7/54 141/198
8,631,837 B2 * 1/2014 Lauber ..... B67D 7/48 141/206
2008/0251366 A1 10/2008 Geppert et al.
2014/0096868 A1 4/2014 Garrison et al.
2016/0176700 A1 6/2016 Clever et al.
2017/0101304 A1 * 4/2017 Geipel ..... B67D 7/3245

OTHER PUBLICATIONS

"GPV 14 Liquid Petroleum Gas (LPG)", by Staubli (Apr. 29, 2009).
Product information featuring "Autogas Nozzle", by Gazeo.com (Jan. 16, 2015).
"GMV 06—Type 1, Natural Gas for Vehicles (NGV)", by Staubli (Dec. 11, 2015).
Staubil Nozzle Description (23 pages) describing nozzle from Jun. 2009.

* cited by examiner

HOLD-OPEN LATCH ASSEMBLY FOR DISPENSING DEVICE

This application claims priority to U.S. Provisional Patent Application Ser. No. 62/168,416, entitled HOLD-OPEN LATCH FOR DISPENSING DEVICE and filed on May 29, 2015, the entire contents of which are hereby incorporated by reference.

The present invention is directed to a latch assembly for a dispensing device, such as a fluid dispensing device, which can retain the dispensing device in an operating (dispensing) position or configuration.

BACKGROUND

Fluid dispensing systems, such as refueling stations and the like, typically include a dispenser with manually operable nozzle for dispensing fluid. In many cases the nozzle includes a lever that is manually raised to operate the nozzle. Nozzles may also include a hold-open latch that retains the lever in the raised position so that the user does not have to manually retain the lever in its raised position. However, many existing hold-open latches may not be sufficiently intuitive or easy to operate and/or may not be sufficiently robust and/or provide ease of manufacture.

SUMMARY

In one embodiment, the present invention is a nozzle system including a nozzle body configured to dispense fluid therethrough and a lever coupled to the nozzle body and movable in a lever plane between a non-operating position and an operating position. The nozzle system further includes a latch assembly having an engagement surface and a cam. The cam is coupled to or positioned on one of the nozzle body or the lever, and the engagement surface is coupled to or positioned on the other one of the nozzle body or the lever. The nozzle system is configured such that when the lever is moved from the non-operating position to the operating position, the engagement surface engages the cam to cause at least one of the engagement surface or the cam to move relative to the other such that the lever is automatically retainable in the operating position by the latch assembly. The cam does not pivot about an axis aligned with the lever plane when the lever is moved from one of the non-operating position or the operating position to the other one of the non-operating position or the operating position.

DETAILED DESCRIPTION

Figure 1:
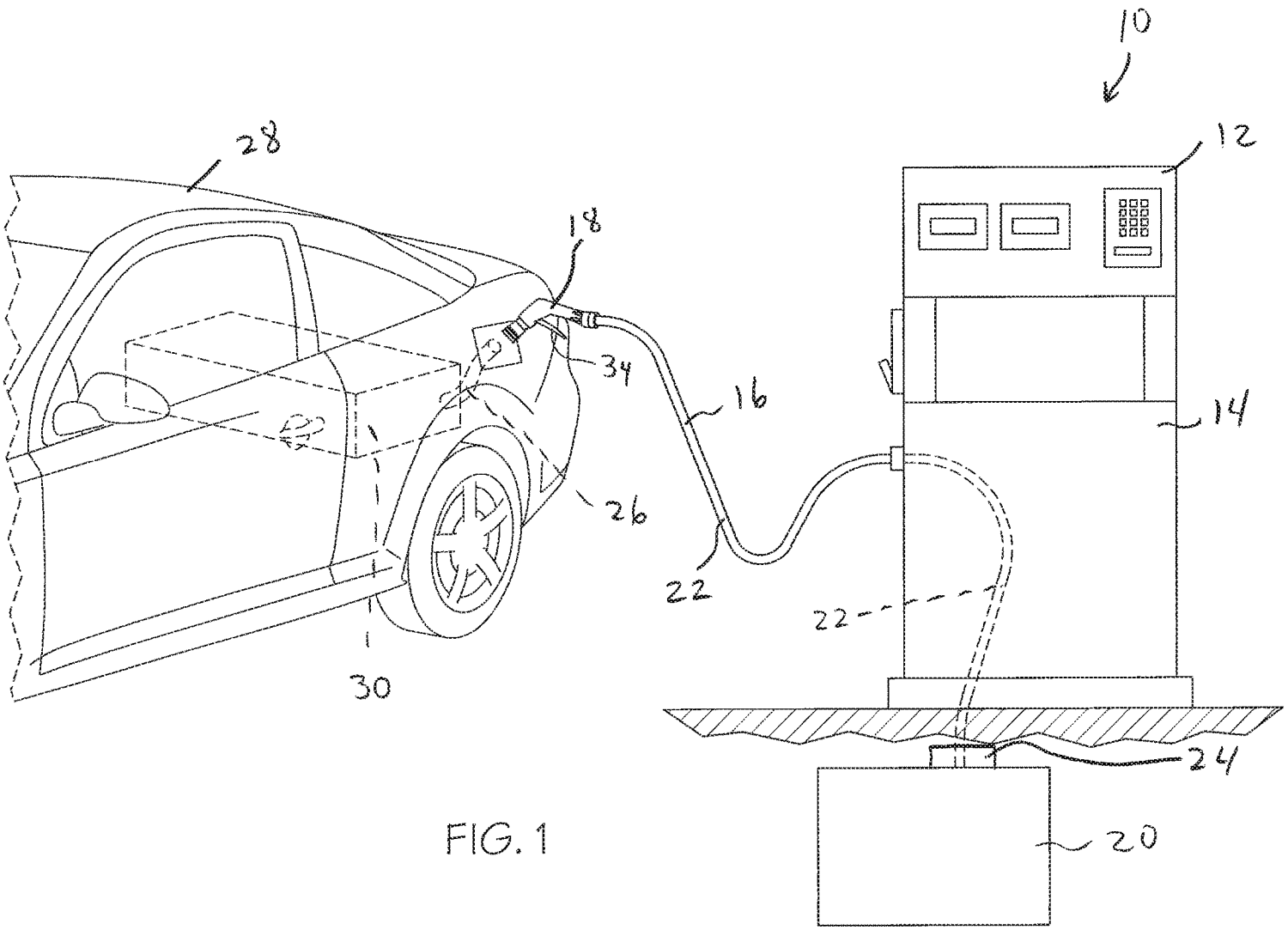
FIG. 1 is a schematic representation of a refueling system.

FIG. 1 is a schematic representation of a refilling system 10 including a dispenser 12. The dispenser 12 includes a dispenser body 14, a hose 16 coupled to the dispenser body 14, and a nozzle 18 positioned at the distal end of the hose 16. The hose 16 may be generally flexible and pliable to allow the hose 16 and nozzle 18 to be positioned in a convenient refilling position as desired by the user/operator.

The dispenser 12 is in fluid communication with a fuel/fluid storage tank 20 via a liquid or fluid conduit or path 22 that defines a fluid path/flow path therein, and extends from the dispenser 12 to the storage tank 20. The storage tank 20 can include or be fluidly coupled to a pump 24 which is configured to draw fluid/fuel out of the storage tank 20 and supply such fluid to the dispenser 12/nozzle 18. The nozzle 18 can be inserted into a fill pipe 26 of a vehicle 28 and operated to fill/refuel a fuel tank 30 of the vehicle 28, or to fill some other fuel/fluid containment vessel.

The system 10 can be utilized to store/dispense any of a wide variety of fluids, liquids or fuels, including but not limited to petroleum-based fuels or fluids, such as gasoline, diesel, natural gas, biofuels, blended fuels, propane, oil, or ethanol the like. The system 10 can also be utilized to store/dispense compressed natural gas ("CNG"), which can take the form of methane in its gaseous state under high pressure, or a combination of gases of mostly methane. In this case the CNG or other fluid can be stored and dispensed under pressure (in one case in the range of between about between about 70 psi and about 10,000 psi, or in another case between about 90 psi and about 4,500 psi, or in another case between about 2,900 and about 3,600 psi, or at least about 70 psi in one case, or at least about 2,000 psi in one case, or in one case less than about 10,000 psi). The system 10 can further be utilized to store/dispense liquefied petroleum gas ("LPG") which can take the form of various liquefied gases including propane, butane, combinations thereof and other additives. The LPG can in one case be stored and dispensed under pressure (in the range of between about 20 psi and about 400 psi).

Figure 2:
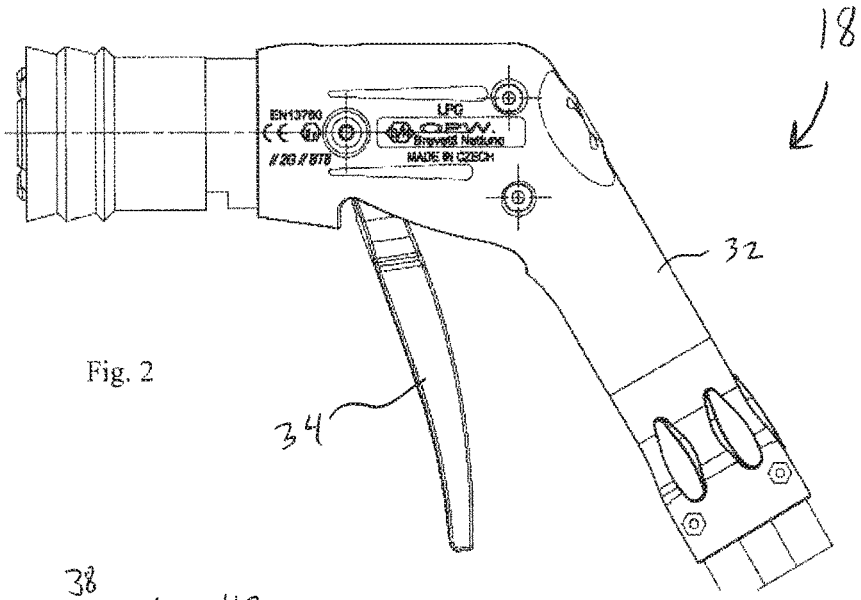
FIG. 2 is a side detail view of a nozzle of the refueling system of FIG. 1.
Figure 3:
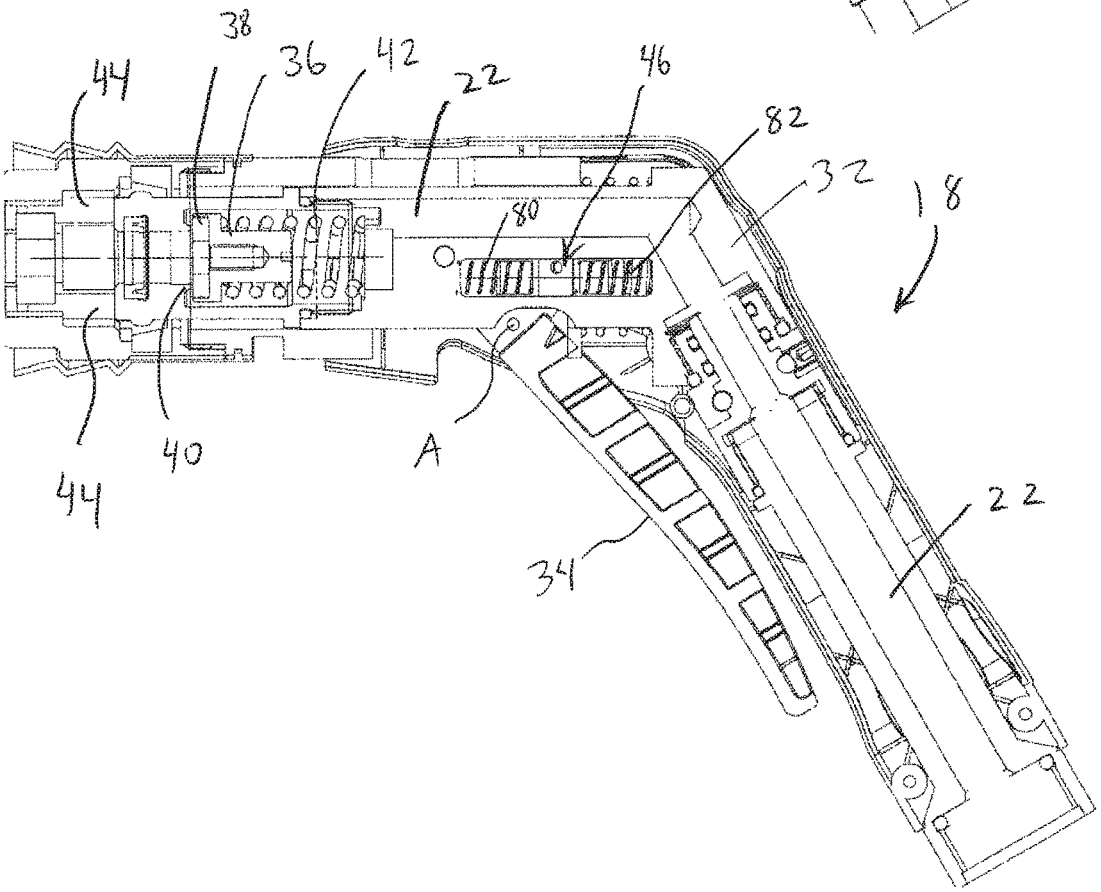
FIG. 3 is a side cross section of the nozzle of FIG. 2, with the lever in an upper, dispensing position.
Figure 4:
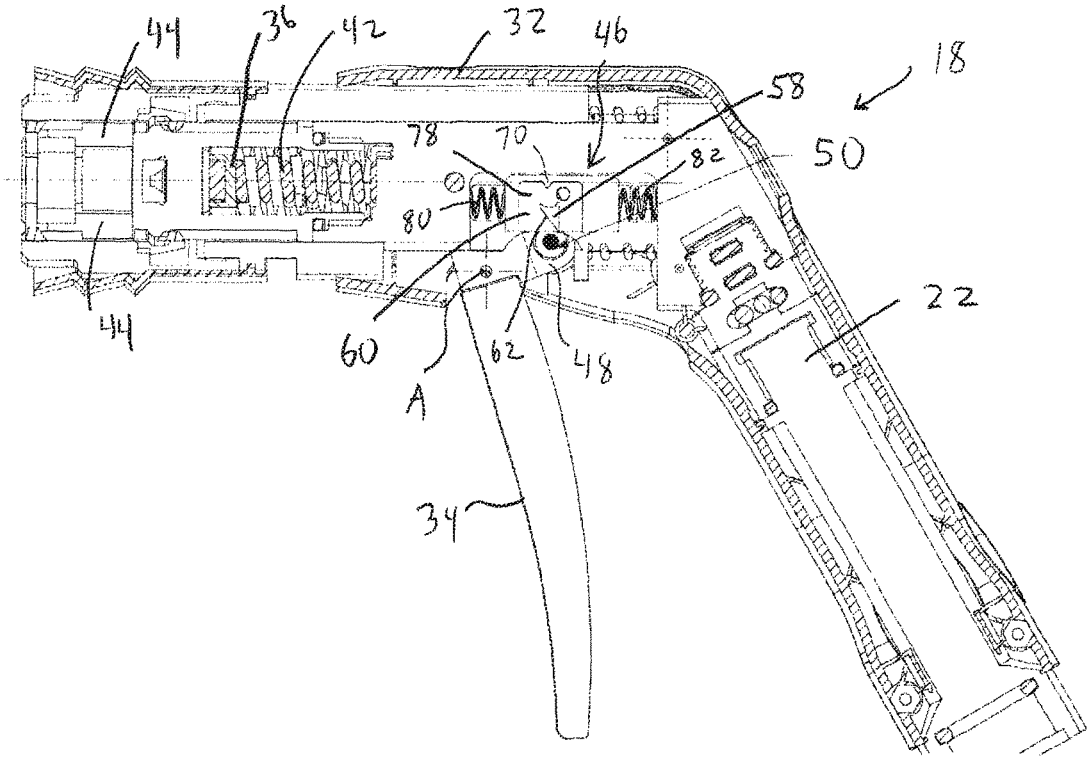
FIG. 4 is a different side cross section of the nozzle of FIG. 2, with the lever in a lower, non-dispensing position.

With reference to FIG. 3, the nozzle 18 can include a fluid path 22 through which fluid flows when the nozzle 18 is properly operated. The nozzle 18 can include a nozzle body 32 and a handle or lever 34 that operatively controls and/or blocks the flow of fluid through the fluid path 22. The lever 34 is pivotable about a pivot axis A and movable between an upper or operating/dispensing position, as shown in FIG. 3 and a lower, home or non-operating/non-dispensing position as shown in FIGS. 2 and 4. With reference to FIG. 3 the nozzle 18 can include a valve 36 positioned in the fluid path 22 which, when opened, allows fluid to flow through the nozzle 18/fluid path 22, and when closed blocks fluid from flowing through the nozzle 18/fluid path 22. The valve 36 can include a gasket or sealing component 38 that sealingly engages a valve seat 40 of the nozzle body 32 when closed (as shown in FIG. 3), and is spaced away from the valve seat 40 when open. The valve 36 can include a valve spring 42 that biases the valve 36 to its closed position.

The nozzle 18 can include a set of generally axially-extending jaws 44 that are circumferentially spaced about the fluid path 22 and positioned adjacent to a distal end of the nozzle 18. The jaws 44 are movable between a radially outer position, shown in FIG. 3, and a radially inner position. The lever 34 of the nozzle 18 of FIG. 3 can be operatively coupled to the jaws 44 via various links, cams, sliders, etc. such that when the lever 34 is operated the jaws 44 move to a radially inner position and/or retract axially (toward the lever 34).

In order to dispense fluids and operate the nozzle 18, the nozzle 18 may first be positioned adjacent to/engage a coupling on a filler valve, fuel tank or the like (not shown) of a fluid receptacle (such as the fuel tank 30 of a vehicle 28). The lever 34 is then raised/actuated to move the lever from its home position (FIG. 4) to its dispensing position (FIG. 3). When the lever 34 is sufficiently raised/actuated the jaws 44 grip the coupling of the fuel tank 30 and move to their radially inner positions, clamping on/engaging the coupling. This movement of the jaws 44 pulls the nozzle 18 and the filler valve/coupling closer together in an axial direction such that the coupling engages the valve 36 and moves the valve 36 to its open position, compressing the spring 42. Fluid may then flow through the fluid path 22 of the nozzle 18, either by a natural pressure of the fluid and/or by a pump, and flow into the fuel tank 30 or other receptacle. When dispensing operations are complete, the lever 34 is released/lowered, which enables the nozzle 18 and coupling of the fuel tank 38 to move axially apart (as urged by the spring 42), which causes the valve 36 to close causes and the jaws 44 to move to their radially outer position, releasing the coupling/filler valve.

Thus the lever 34 can be directly or indirectly operatively coupled or coupleable to the valve 36, and in appropriate conditions the lever 34 and/or operation of the lever 34 controls the flow of fluid through the nozzle 18, and therefore the dispensing operations of the nozzle 18. When the lever 34 is in its non-dispensing position the flow of fluid through the fluid path 22/nozzle 18 is blocked or prevented, and when the lever 34 is in its dispensing position (and conditions are appropriate) the flow of fluid through the fluid path 22/nozzle 18 is not blocked and is permitted. The lever 34 may be biased to its non-dispensing position via a spring or the like.

In the illustrated embodiments, when the lever 34 is in its non-dispensing position, the lever 34 is in a lower position and positioned such that a distal end of the lever 34 (in one case, the portion of the lever 34 opposite or spaced away from the pivot point A) is spaced away from the nozzle body 32, or at least those portions of the nozzle body 32 through which fluid flows. Conversely, in the illustrated embodiments when the lever 34 in its dispensing position the lever 34 is in an upper/raised position and positioned such that a distal end of the lever 34 is positioned adjacent the nozzle body 32, or at least those portions through which fluid flows. However, these configurations could be reversed, and other arrangements could be utilized. Further details relating to certain aspects of the nozzle can be found in European Patent No. 1,669,663 entitled Facilitated Operation of Gaseous Fuel Dispenser Pistol, the entire contents of which are hereby incorporated herein by reference.

The nozzle 18 can include a hold-open latch or latch assembly, generally designated 46. The latch assembly 46 is configured to automatically retain the lever 34 in the raised, dispensing or operating position in the illustrated embodiment, although the latch assembly 46 can be configured to retain the lever 34 in various other positions. In the embodiment of FIGS. 1-9, with particular reference to FIG. 4, it can be seen that the latch assembly 46 includes a rearwardly-extending lever extension 48 that is integral with or rigidly coupled to the lever 34, positioned relatively close to the pivot axis A. The lever extension 48 includes or carries a cam follower or engagement surface 50, in the form of a generally cylindrical pin in one case.

Figure 5:
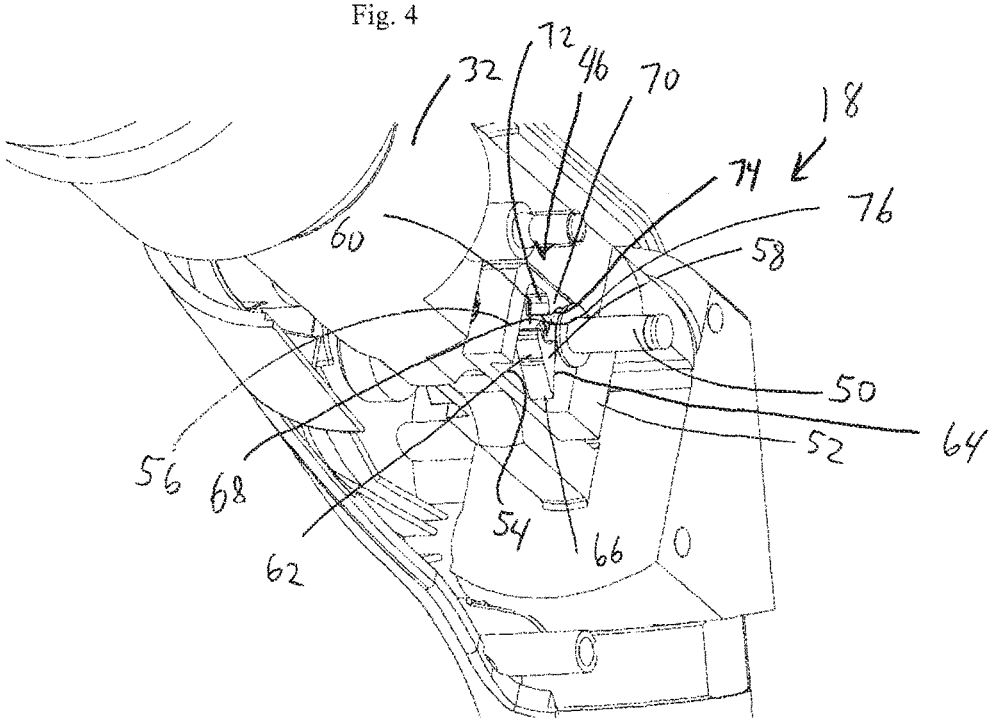
FIG. 5 is a lower perspective view of the latch assembly of the nozzle of FIGS. 2-4, with the pin in a raised position.

With reference to FIG. 5, the latch assembly 46 can include a laterally movable latch body 52 coupled to the nozzle body 32. The latch body 52 includes a base surface 54 and an outer frame 56, and a cam or cam body 58 extending forwardly and away from the base surface 54. The outer frame 56 and cam body 58 can each be formed as a projection that extends forwardly from the base surface 54 of the latch body 52, having a generally constant cross section in the illustrated embodiment, although the cross section could also vary if desired. The outer frame 56 and cam body 58 are spaced apart and together define an opening, recess or space 60 positioned therebetween and facing the pin 50.

Figure 9:
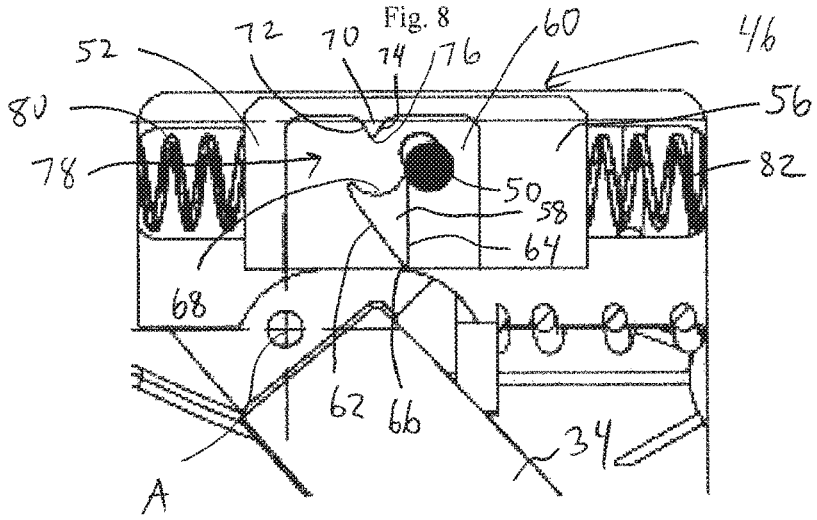
FIG. 9 shows the latch assembly of FIG. 8 with the lever slightly lowered from the position of FIG. 8.

With reference to, for example, FIG. 9, the cam body 58 can be generally "Y" shaped in side view, and include an inner angled or curved surface 62 and an outer angled or curved surface 64 which meet at a downwardly-pointing point or apex 66 at or near a bottom end of the cam body 58. The cam body 58 further includes a depression, recess or the like 68 positioned on an upper, distal end of the cam body 58 and positioned between the inner surface 62 and outer surface 64. In the illustrated embodiment the surfaces 62, 64 are curved or angled in side view; e.g. in one case in a plane defined by pivoting motion of the lever 34.

The outer frame 56 of the latch body 52 can include a guide 70 in a generally "V" shape having an inner surface 72 and an outer surface 74 which meet in a downwardly-pointing point or apex 76 at or near the bottom of the guide 70. The point 76 at the bottom of the guide 70 is positioned opposite from and/or directed at the recess 68 of the cam 58. The latch body 52 can include a gap 78 between the guide 70 and the cam 58. The cam body 58 and frame 56 can thereby define the opening 60 which can be generally heart-shaped, or generally "M" shaped, or generally (but not necessarily identically) shaped as a cardioid plane curve. The opening 60/path traced by the pin 50 can be generally flat and planar (i.e. in an orthogonal plane) in one embodiment; i.e. the opening 60 is in one case carried on a generally flat and planar component such that the path 60 generally does not vary in distance from the pin 50 in a longitudinal direction of the nozzle body 32.

The latch body 52 is movable in a direction (as shown by doubled-ended arrow B of FIG. 6) that is parallel with the central/longitudinal axis of the nozzle 18 and parallel with a plane defined by pivoting motion of the lever 34, and perpendicular to the axis A of the lever 34. The latch assembly 46 includes a pair of springs or other biasing devices 80, 82 positioned on opposite side of the latch body 52. The springs 80, 82 bias the latch body 52 to its neutral position shown in FIG. 4, in which the pin 50 does not contact or apply any forces to the cam body 58/latch body 52.

FIGS. 4 and 6-9 provide certain cross sections of the nozzle 18 of FIGS. 1 and 2, illustrating the latch assembly 46 on one side of the nozzle 18. However, it should be understood that the same or similar latch structure, which can be mirror-imaged as necessary, can be positioned on the other side of the nozzle 18. If two latch assemblies 46 are utilized, then the latch oppositely-positioned pins 50 can be pinned or otherwise connected together to ensure coordinated movement, and the oppositely positioned latch bodies 52 can also be pinned or otherwise connected together to ensure coordinated movement in the direction of arrow B.

FIG. 4 illustrates the nozzle 18 with the lever 34 in its lower, non-dispensing home position. In the illustrated embodiment the pin 50 is positioned below the inner surface 62 of the cam body 58. In order to operate the nozzle 18/latch assembly 46, a user can grasp the nozzle 18 and operate/actuate the lever 34, raising and pivoting the lever 34 about its pivot axis A. As the lever 34 is raised and pivoted, the pin 38 enters the opening 60 of latch body 52 adjacent to the inner surface 62 of the cam body 58, and engages the inner surface 62 of the cam body 58. Since the pin 50 will swing along an arc as the lever 34 is rotated, the inner surface 62 may extend generally along the arcuate path but may provide progressively greater interference as the lever 34/pin 50 is raised/pivoted. As the lever 34 is pivoted in this manner the pin 50 pushes on the inner surface 62, thereby moving the cam 58 and latch body 52 laterally (to the right in the illustrated embodiment), compressing spring 82 and expanding spring 80, as shown in FIG. 6.

As the pin 50 rises in the latch body 52 the pin 50 will eventually be moved beyond the inner surface 62 of the cam body 58, and move across or jump the gap 78 between the cam body 58 and guide 70, as guided by the shape of the inner surface 62 of the cam body 58 and movement of the lever 34. After jumping the gap 78 the pin 50 engages the inner surface 72 of the guide 70, as shown in FIG. 6. The pin 50 can be sized to be sufficiently large such that the pin 50 does not fit through the gap 78 without first engaging the inner surface 72 of the guide 70. This engagement between the pin 50 and guide 70 and/or adjacent surfaces of the latch body 52 can act as a hard stop, preventing any further upper/pivoting movement of the lever 34 and providing tactile feedback to the user.

Figure 6:
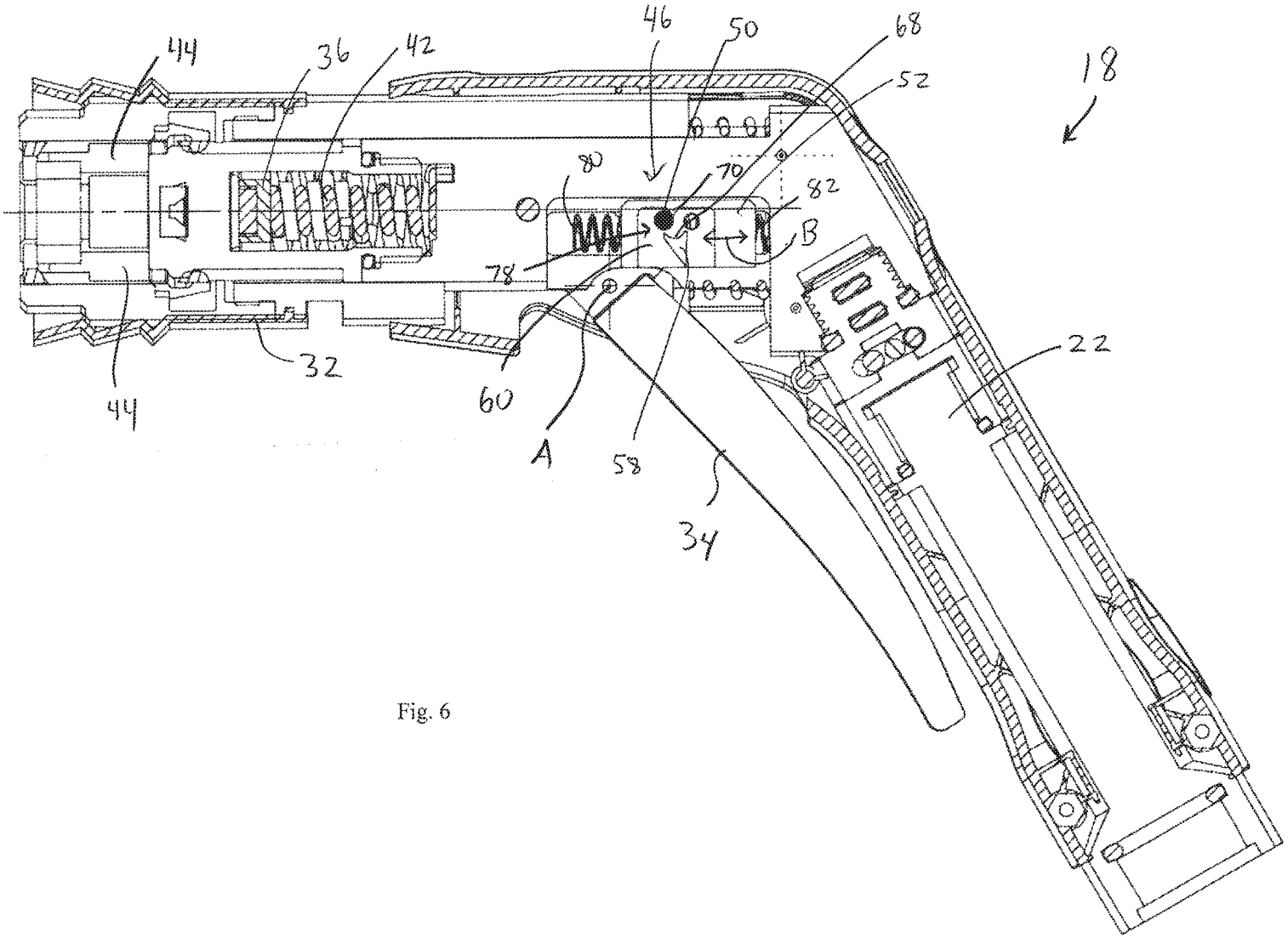
FIG. 6 shows the nozzle of FIG. 4 with the lever fully raised.
Figure 7:
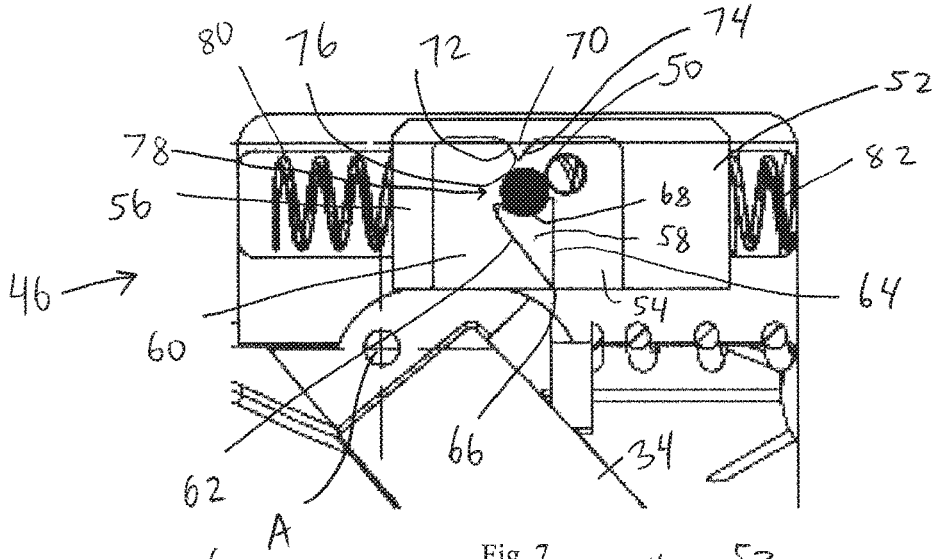
FIG. 7 is a detail front view of the latch assembly of the nozzle of FIG. 6, with the lever slightly lowered from the position of FIG. 6 and with the nozzle retained in a dispensing position.

After the lever 34 is fully raised and/or engages the first hard stop shown in FIG. 6, the user can then release the lever 34, causing the lever 34 and pin 50 to move downwardly slightly due to the biased nature of the lever 34. The pin 50 moves downwardly and is guided to the recess 68 of the cam 50 by the inner surface 72 of the guide 70. Thus such movement causes the pin 50 to be received in the recess 68, as shown in FIG. 7, due to the shape of the inner surface 72, and/or inward movement of the latch body 52 toward its neutral position by the springs 80, 82. The pin 50 can be sized to be sufficiently large that the pin 50 must be seated in the recess 68, at least temporarily, before passing through the recess 78, as the recess 78 effectively forms a "labyrinth" passage which relatively closely receives the pin 50 therein.

Once the pin 50 is in the position shown in FIG. 7, the pin 50 is stably held in position as it is cradled by the recess 68 which extends up on either side thereof. The user can then entirely manually release the lever 34, and the nozzle 18/lever 34 will be maintained in the operating, latched or dispensing position shown in FIG. 7. The springs 80, 82 may continue to bias the latch body 52 to move to its neutral position (to the left in FIG. 7) when the nozzle 18/lever 34 is in this position, but the bias force is not sufficient to overcome the seating of the pin 50 in the recess 68 (i.e. due to spring force acting on the lever 34 and urging the lever 34 downwardly). In one case, the lever 34 is raised to sufficiently open the valve 36 at least about 80% towards its fully open position, or at least about 90% in another case, and/or the lever 34 is raised about 80% or 90% of its range of motion when the lever 34 is retained in the retainer/dispensing position.

Figure 8:
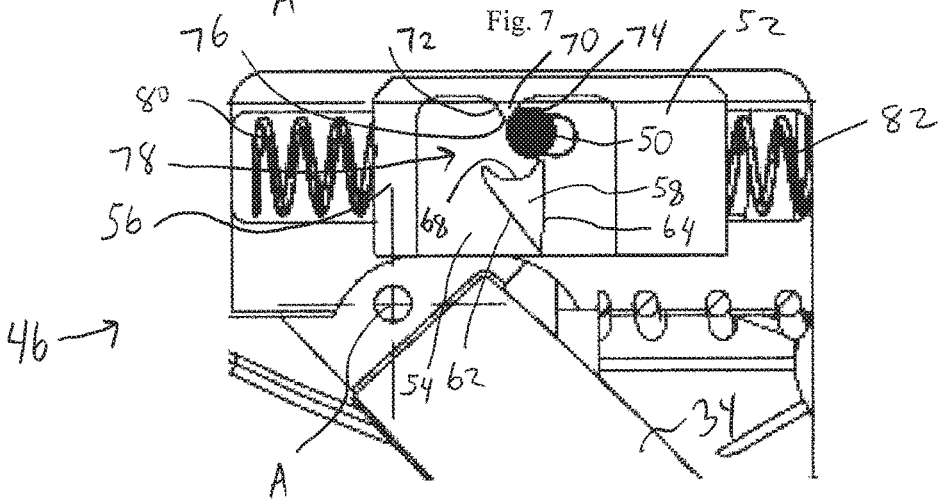
FIG. 8 shows the latch assembly of FIG. 7 with the lever slightly raised from the position of FIG. 7.

When it is desired to move the nozzle 18/lever 34 out of the latched/dispensing position of FIG. 7 (for example, when an automatic shut-off feature of the nozzle 18 has been actuated or it is desired to stop dispensing), a user can grasp the lever 34 and raise the lever 34 slightly, as shown in FIG. 8. Raising the lever 34 causes the pin 50 to lift away from the recess 68 and engage the outer surface 74 of the guide 70 as guided by the shape of the recess 68. When the pin 50 engages the outer surface 74 and/or adjacent surfaces of the latch body 52, the pin 50 is blocked from being raised any further and the user experiences a second hard stop, providing tactile feedback. In some cases, an automatic shut-off feature of the nozzle 18 can be designed to jolt and automatically cause the pin 50 to lift out of the recess 68 and move from the position of FIG. 7 to the position of FIG. 8. In either case, once the pin 50 is raised out of the recess 68 the latch body 52 returns to its neutral position as biased by the springs 80, 82 and shown in FIG. 9.

In any case, one the lever 34 has reached its second hard stop position shown in FIG. 8, the user can then release the lever 34 and/or guide the lever 34 to its lower, non-dispensing position and the pin 50 engages or passes along the outer surface 64 of the cam 58 as shown in FIG. 9. In some cases the pin 50 may engage the outer surface 64 and move the cam body 58 and latch body 52 laterally (to the left in the illustrated embodiment), compressing spring 80 and expanding spring 82. As the lever 34 is further released the pin 50 clears the cam body 58 and latch body 52, which return to their neutral positions, and the lever 34 and nozzle 18 return to their home positions shown in FIGS. 2 and 4.

It can thus be seen that the pin 50 moves about the cam 58 and forms a closed loop (a generally heart-shaped loop in one case) about the cam 58 when the lever 34 is moved from the non-dispensing position to the dispensing position, and then returned from the dispensing position back to the non-dispensing position. The loop can be non-linear and defines a closed loop shape with a central opening. Thus operating the nozzle 18/lever 34 is easy and intuitive, as the user needs only to sufficiently raise the lever 34 to a hard stop and then release the lever 34, at which time the lever 34 is positioned in and automatically retained in an open/dispensing position, and the user does not need to manually move or engage a latch assembly or any component thereof. After dispensing operations are complete the user then only needs to again sufficiently raise the lever 34 to another hard stop, and fully release/lower the lever 34, at which time the lever 34 is returned to its non-dispensing position. The latch assembly 46 can operate somewhat in the manner of certain push-push mechanisms, although the latch assembly 46 can differ in structure and/or operation.

In the embodiment described above, the latch body 52 and cam 58 are positioned on/in the nozzle body 32 and the pin 50 is positioned on the lever 34. However, if desired this configuration can be reversed such that the latch body 52 and cam 58 are positioned on the lever 34 and the pin 50 is positioned on the nozzle body 32. In addition, in the embodiment described above the latch body 52 and cam 58 are movable by the engagement of the cam 58 with the pin 50. However, this configuration can, too, be reversed such that for example the latch body 52 and cam 58 are fixed and the pin 50 is movable, for example spring-biased into place but laterally adjustable. Further alternatively, both the latch body 52/cam 58 and the pin 50 may be movable/adjustable.

Figure 10:
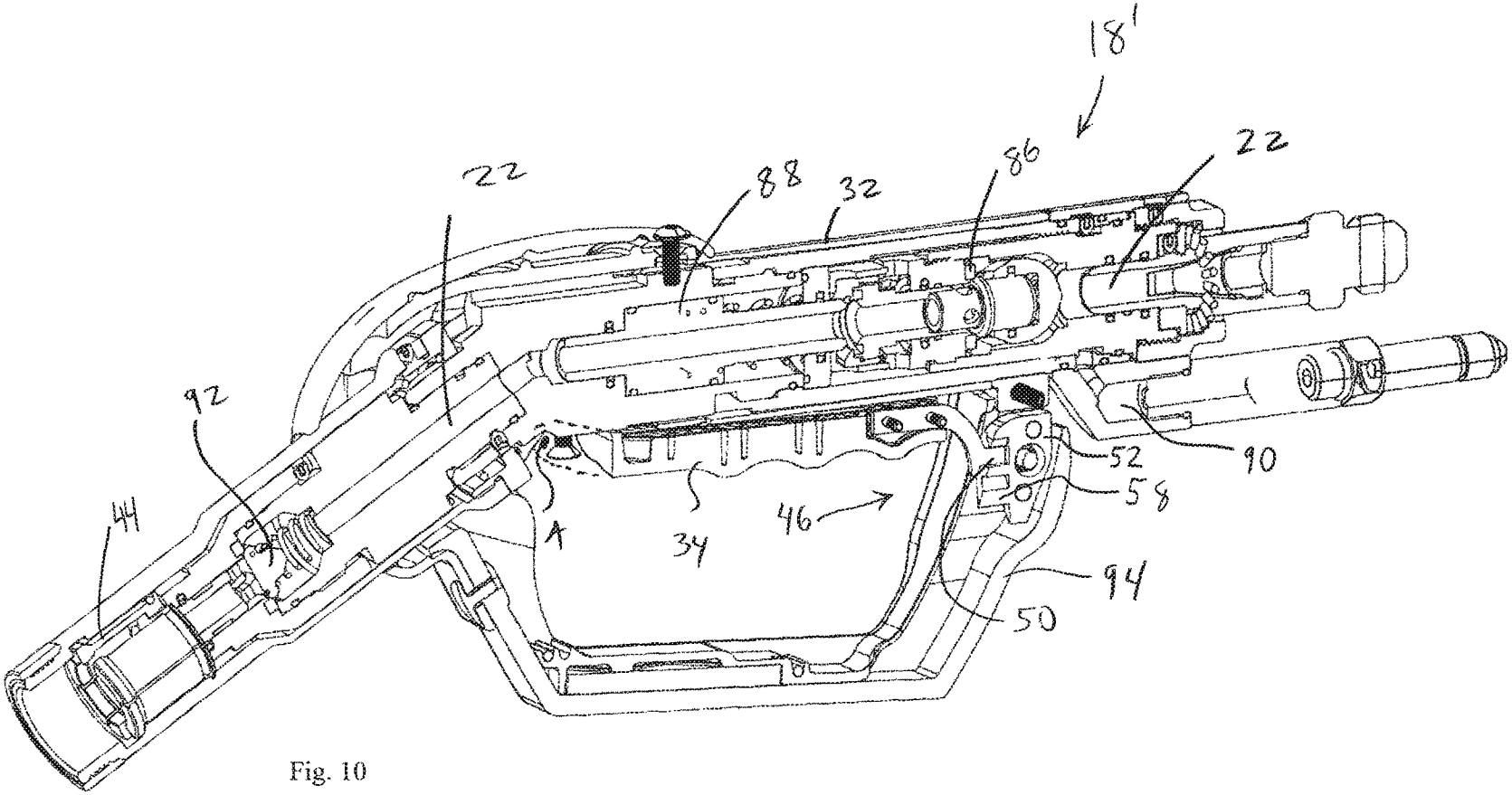
FIG. 10 is a side perspective cross section of an alternative nozzle that is useable in the refueling system of FIG. 1 with the lever in a raised position.

FIGS. 10-18 illustrate another embodiment of a nozzle 18' with a latch assembly 46 that operates on somewhat similar principles as the nozzle 18 and latch assembly 46 shown in FIGS. 1-9 and described above. With reference to FIG. 10 the nozzle 18' can include a fluid path 22 and an inlet valve 86 in the fluid path 22, which can be biased to its closed/sealed position. The nozzle 18' can further include a vent valve 88 in the fluid path 22 and positioned downstream of the inlet valve 86. The vent valve 88 can be biased to its open position and can provide venting to a vent outlet path 90 when open. The nozzle 18' can also include an outlet valve 92 in the fluid path 22 and positioned downstream of the inlet valve 86 and the vent valve 88. The outlet valve 92 can be biased to its closed position. The nozzle 18' can further include a set of jaws 44 at a distal end of the nozzle 18' that are pivotable between a radially inner position, shown in FIG. 10, and a radially outer position (not shown) when the lever 34 is in its lower/home position, in a manner analogous to the jaws 44 of the nozzle 18 of FIGS. 1-9.

The lever 34 can be operatively coupled to the inlet valve 86, vent valve 88, and jaws 44 via various links, cams, sliders, etc. In order to dispense fluids and operate the nozzle 18', the nozzle 18' may first engage a coupling on a filler valve, fuel tank or the like (not shown), which engages and axially moves the outlet valve 92, opening the outlet valve 92. The lever 34 is then raised/actuated, and when the lever 34 is sufficiently raised the vent valve 88 is closed, the inlet valve 86 is opened, and the jaws 44 move to their radially inner position, clamping on/engaging the filler valve. When dispensing operations are complete, the lever 34 is released/lowered, which causes the vent valve 88 to open, the inlet valve 86 to close and the jaws 44 to move to their radially outer position, releasing the filler valve. The nozzle 18' can then be moved away from the filler valve, causing the outlet valve 92 to close. Further details relating to certain aspects of the nozzle 18' can be found in U.S. patent application Ser. No. 14/575,624 entitled Nozzle for Dispensing Pressurized Fluid, filed on Dec. 18, 2014 the entire contents of which are hereby incorporated herein by reference.

The nozzle 18' includes a latch assembly 46 that provides the same or similar functionality to the latch assembly described above in the embodiment of FIGS. 1-9, and utilizes a latch body 52 and cam body 58 that are analogous to the latch body 52 and cam 58 of the embodiment of FIGS. 1-9. However, in the embodiment of FIGS. 10-18, instead of being movable is a direction parallel to a central/longitudinal axis of the nozzle 18', the latch body 52/cam 58 is movable in a direction perpendicular to the central axis of the nozzle 18', and parallel to the axis A of the lever 34. For example, the cam 58 is movable generally into and out of the page with reference to FIG. 10, and with reference to FIG. 13 the cam 58 is movable in a left and right direction. The cam 58 can be located near or received in the base of a hand guard 94 of the nozzle 18', and the latch assembly 46 in this case may be able to be used in a standard dispenser nozzle boot. In addition, the latch body 52 may lack an outer frame 56 that extends around the sides of the cam body 58, but the outer frame 56 may be positioned above the cam body 58 and carry/support the guide 70.

Figure 13:
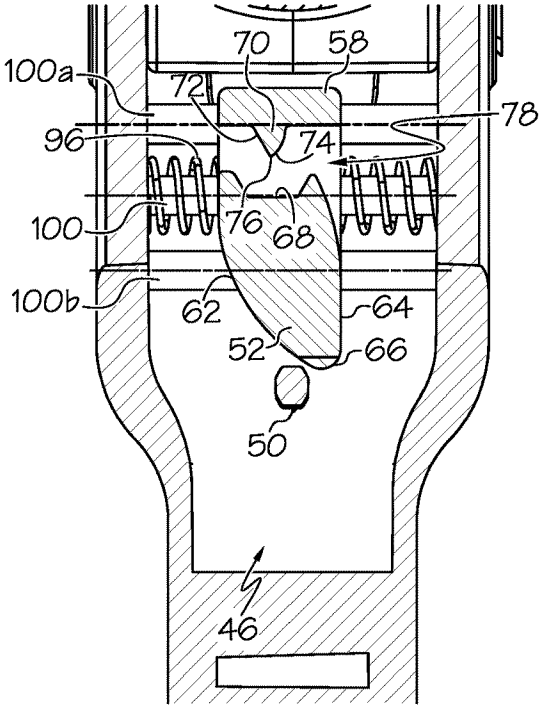
FIG. 13 is a cross section of the latch assembly of the nozzle of FIG. 10, with the lever in its lower, non-dispensing configuration.

With reference to FIG. 13, the latch body 52 is movable laterally and biased to its neutral position by a pair of springs 96, 98. A pin or guide body 100 can extend through the springs 96, 98, and the latch body 52 such that the latch body 58 is slidably carried on the guide body 100. In this manner, the guide body 100 secures the springs 96, 98 in place and guides movement of the cam body 58. Additional guide bodies **100*a*, 100*b*, in the form of pins or the like, can be received through the latch body 52**.

Figure 14:
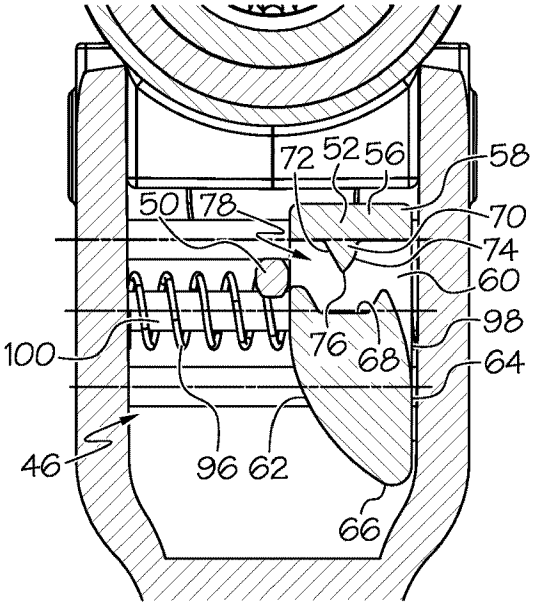
FIG. 14 shows the latch assembly portion of FIG. 13, with the lever nearly fully raised.

The engagement surface 50 in this embodiment takes the form of a protrusion or pin positioned on a distal end of the lever 34, opposite the pivot axis A of the lever 34. By locating the engagement surface 50 distant from the pivot axis A the leveraged mechanical advantage is maximized. FIG. 10 illustrates the nozzle 18' with the lever 34 and protrusion 50 in its upper, operating/dispensing position. In order to operate the nozzle 18'/latch assembly 46 a user can raise and pivot the lever 34 from its lower position about its axis A to the position shown in FIG. 10. With reference to FIG. 13, during initial movement of the lever 34, the pin 50 engages the inner surface 62 of the cam body 58. The pin 50 thus pushes on the inner surface 62, thereby moving the cam 58 laterally (to the right in the embodiment shown in FIG. 13), compressing spring 98 and extending spring 96, as shown in FIG. 14). In this embodiment then the inner surface 62 (and outer surface 64) of the cam 58 are curved or angled in a plane parallel to the pivot axis A, or perpendicular to a longitudinal axis of the nozzle 18'.

As the pin 50 rises and slides against the cam 58 the pin 50 will eventually enter into the gap 78 of the cam 58, enabling the cam 58 to at least partially return toward its neutral position, moving to the left until the pin 50 engages the inner surface 72 of the guide 70. This engagement between the pin 50 to guide 70 can act as a hard stop, preventing any further raising of the lever 34.

Figure 11:
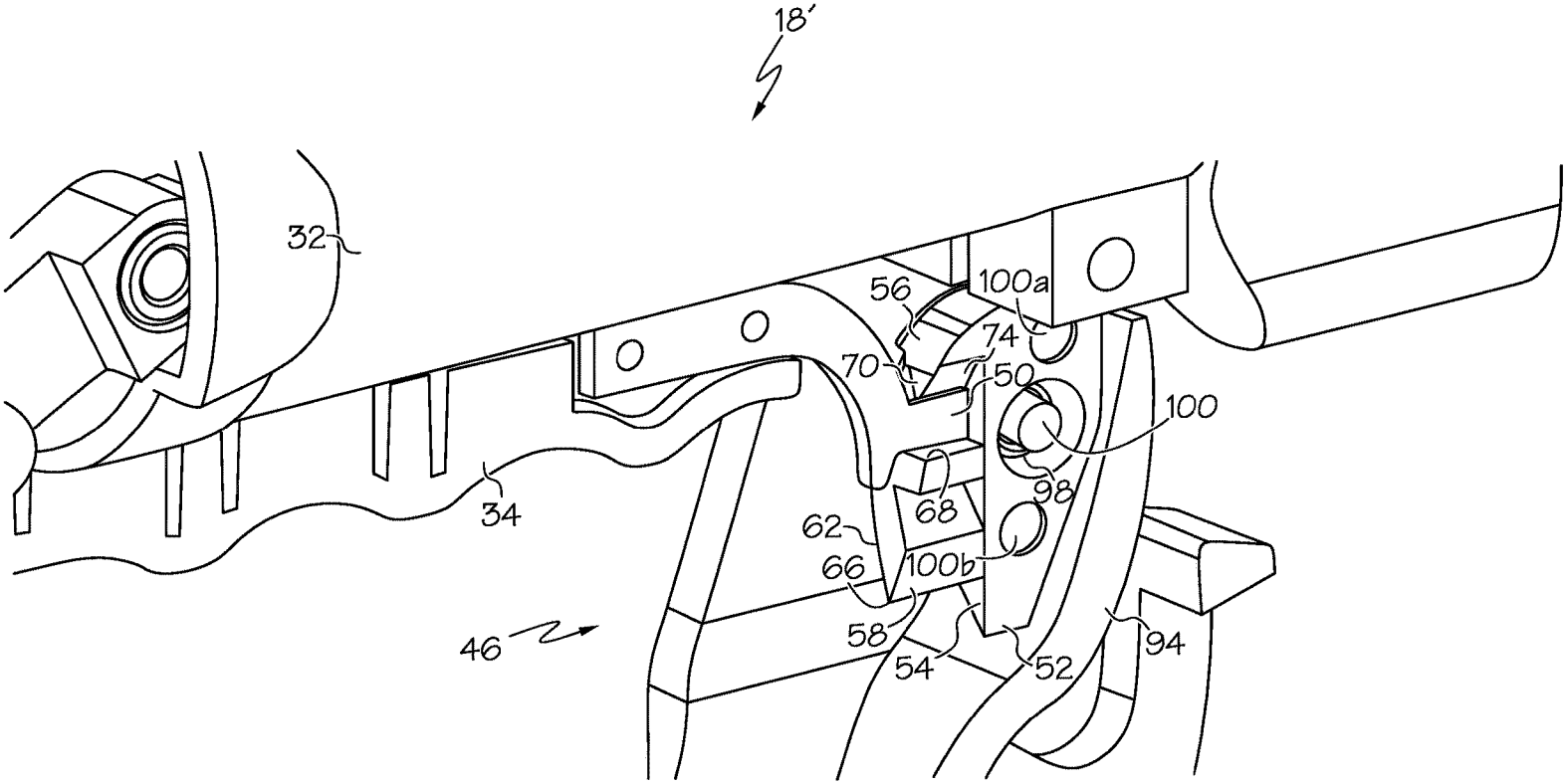
FIG. 11 is a detail view of the latch assembly of the nozzle of FIG. 10.
Figure 12:
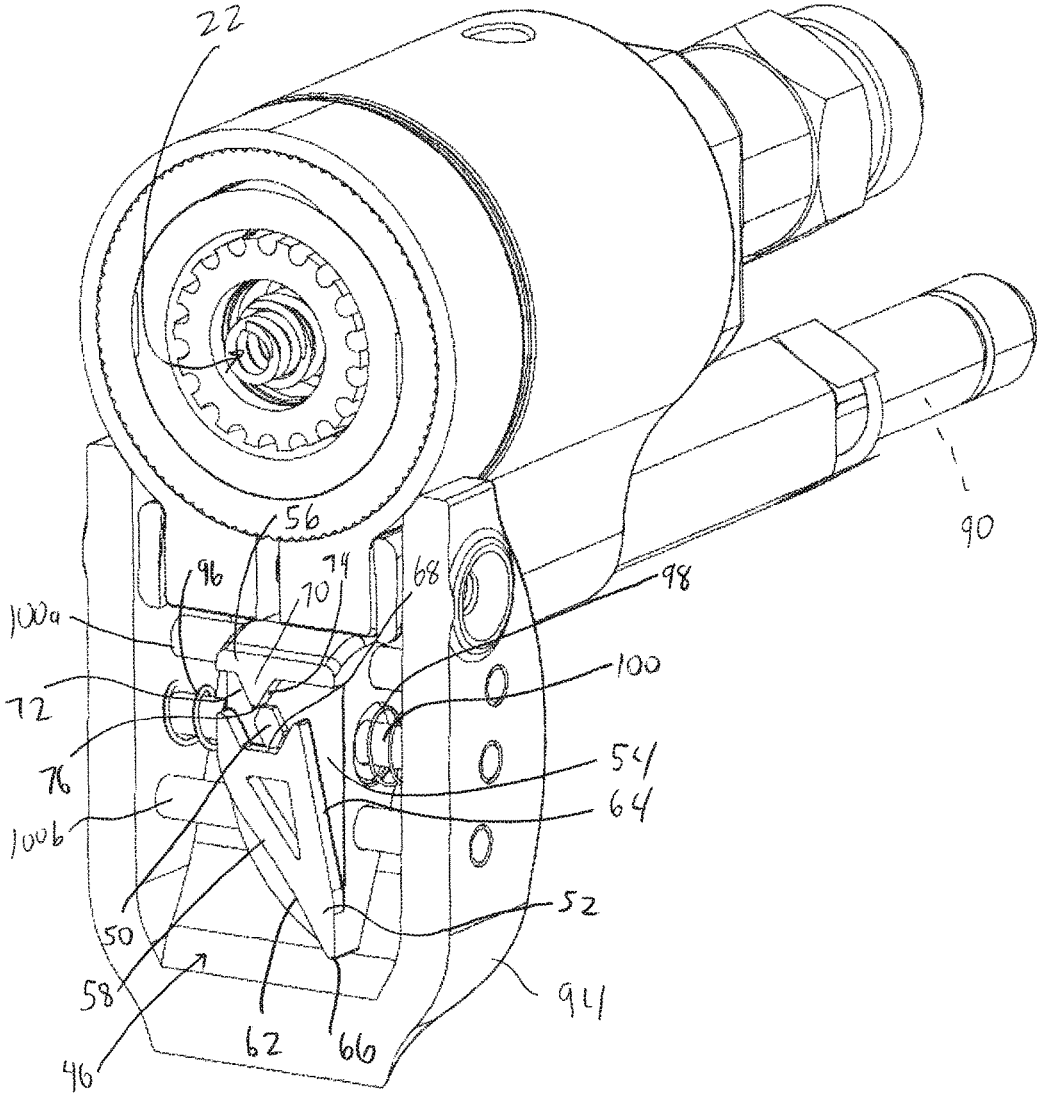
FIG. 12 is a front perspective cross section of the nozzle of FIG. 10, showing the latch assembly.
Figure 15:
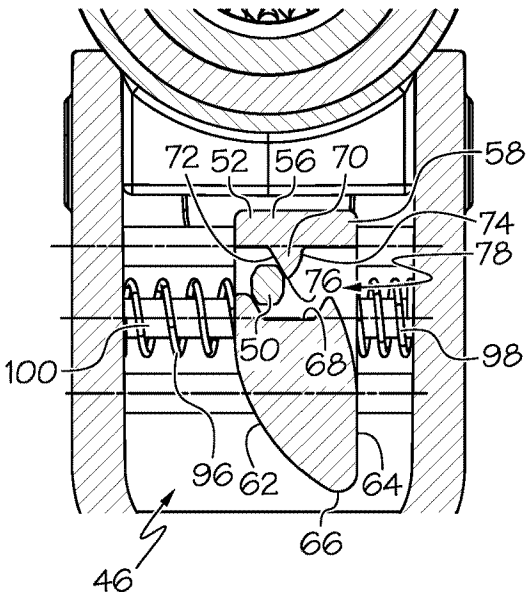
FIG. 15 shows the latch assembly portion of FIG. 14, after the lever has been fully raised and the cam moved slightly inwardly from the position of FIG. 14.
Figure 16:
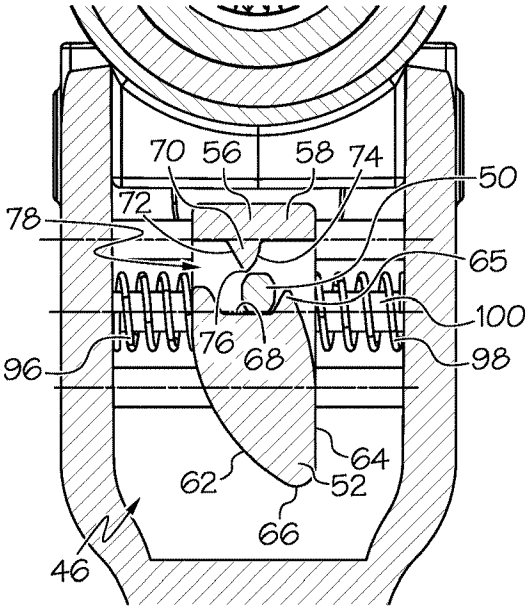
FIG. 16 shows the latch assembly portion of FIG. 15, with the lever slightly lowered, the cam moved slightly inwardly and the nozzle retained in a dispensing position.

The user can then release the lever 34, causing the lever 34 and pin 50 to move downwardly slightly, as shown in FIG. 15. The downward movement of the pin 50 causes the pin 50 to be received in the recess 68 of the cam body 58, as shown in FIG. 16, due to the shape of the inner surface 72 of the guide 70 and/or lateral movement of the cam 58 by the springs 96, 98. Once the pin 50 is in the position shown in FIG. 16, the pin 50 is stably held in place as it is cradled by the recess 68. The user can then completely manually release the lever 34, and the nozzle 18'/lever 34 will be maintained in the operating, latched or dispensing position shown in FIG. 16 (FIGS. 10-12). The springs 96, 98 may continue to bias the cam 58 to the left when the nozzle 18'/lever 34 is in this position, but the spring force is not sufficient to overcome the seating of the pin 50 in the recess 68. Alternatively, the cam 58 may be in a neutral position in the position shown in FIG. 16 but the pin 50 is positioned vertically below the outer surface 74 of the guide 70 which can guide the pin 50 when it exits the recess 68.

Figure 18:
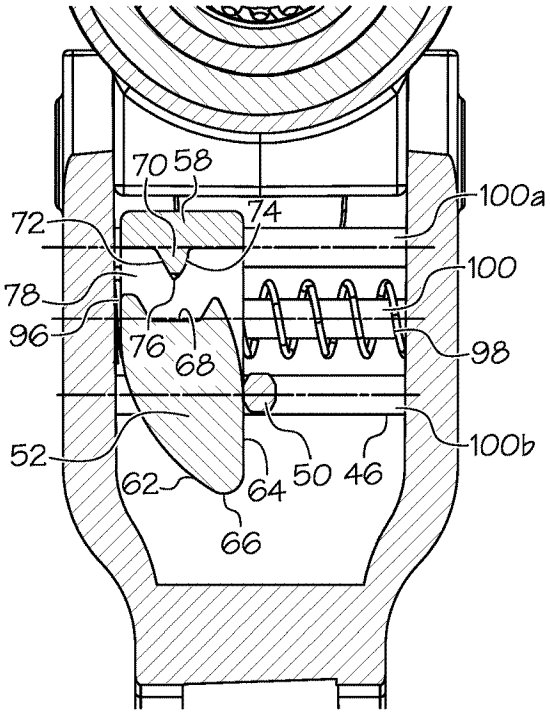
FIG. 18 shows the latch assembly portion of FIG. 17 with the pin lowered from the position of FIG. 17 and outside the cam.
Figure 17:
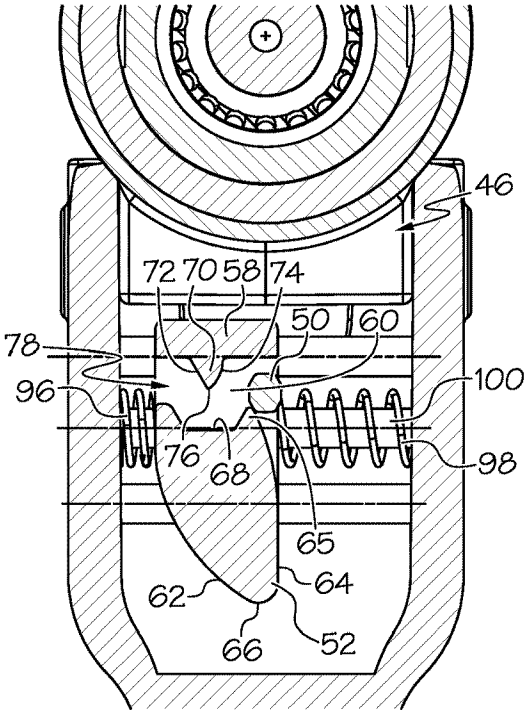
FIG. 17 shows the latch assembly portion of FIG. 16 with the lever slightly raised from the position of FIG. 16 and the cam moved laterally.

When it is desired to move the nozzle 18'/lever 34 out of the latched position, a user can grasp the lever 34 and raise the lever 34 slightly. Raising the lever 34 causes the pin 50 to engage the outer surface 74 of the guide 70, guiding the pin 50 laterally away from the recess 68 until the pin 50 reaches a second hard stop at the base of the guide 70. The user can then release the lever 34 (enabling the lever 34 to move quickly on its own) or guide the lever 34 to its lower, non-dispensing position (in a more controlled movement), as shown in FIGS. 17 and 18. In either case the pin 50 can engage the outer surface 64 of the cam 58, urging the cam 58 in a direction from opposite to that the cam 58 was urged during initial actuation of the lever 34. This lateral movement of the cam 58 compresses spring 16 and expands spring 98, as shown in FIGS. 17 and 18. Once the lever 34 is sufficiently lowered, the pin 50 clears the cam 58 and the cam 58 is free to return to its neutral position, as biased by the springs 96, 98 as shown in FIG. 13.

The cam body 58 and springs 96, 98 can be configured such when the cam body 58 is in its neutral position, and when the lever 34 is initially engaged, point 66 of the cam body 58 (FIG. 13) is laterally offset (to the right side in the illustrated embodiment) from the pin 50 and so the pin 50 engages and rides along the inner surface 62 when raised. The neutral position of the cam body 58 may also be arranged such that when the lever 34 is raised and released a second time to disengage the latch assembly 48 (FIG. 17), the upward facing point 65 defined by the intersection of recess 68 and outer surface 64 is laterally offset (to the left side in the illustrated embodiment) from the pin 50 such that when the lever 34 is released, the pin 50 falls to the right side of said point 65 and slides along the outer surface 64. Thus the cam body 58 may not necessarily be centered (in a lateral, or left-to-right direction in FIGS. 13-18) when in its neutral position.

In this embodiment the pin 50 moves about the cam 58 and forms a closed loop (a generally heart-shaped loop in one case) in the same or a similar manner to that of the embodiment of FIGS. 1-9. In addition operating the nozzle 18'/lever 34 is easy and intuitive, as the user needs only to sufficiently raise the lever 34 to a hard stop and then release the lever 34 to dispense fluid and have the lever 34 retained in a dispensing position, and then again raise the lever 34 to a hard stop and release the lever 34, to return the nozzle 18' to its non-dispensing configuration. In addition, in the embodiment of FIGS. 10-18 the position of the pin 50 and cam 58 can be reversed in the same or similar manner as outlined above in the context of the FIGS. 1-9 embodiment, and/or one or both of the pin 50 and cam 58 can be movable and cause displacement of the other, as described above in the context of the embodiment of FIGS. 1-9.

Figure 19:
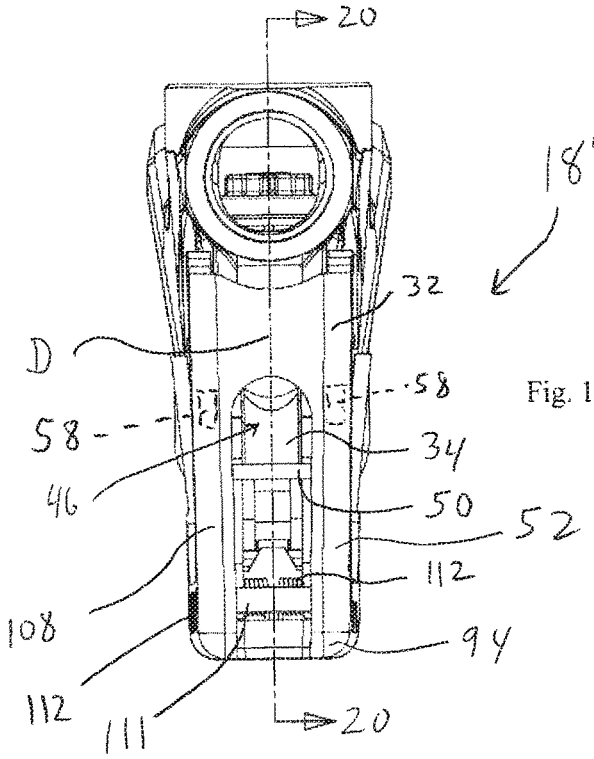
FIG. 19 is an end view of an alternative nozzle that is useable in the refueling system of FIG. 1.
Figure 20:
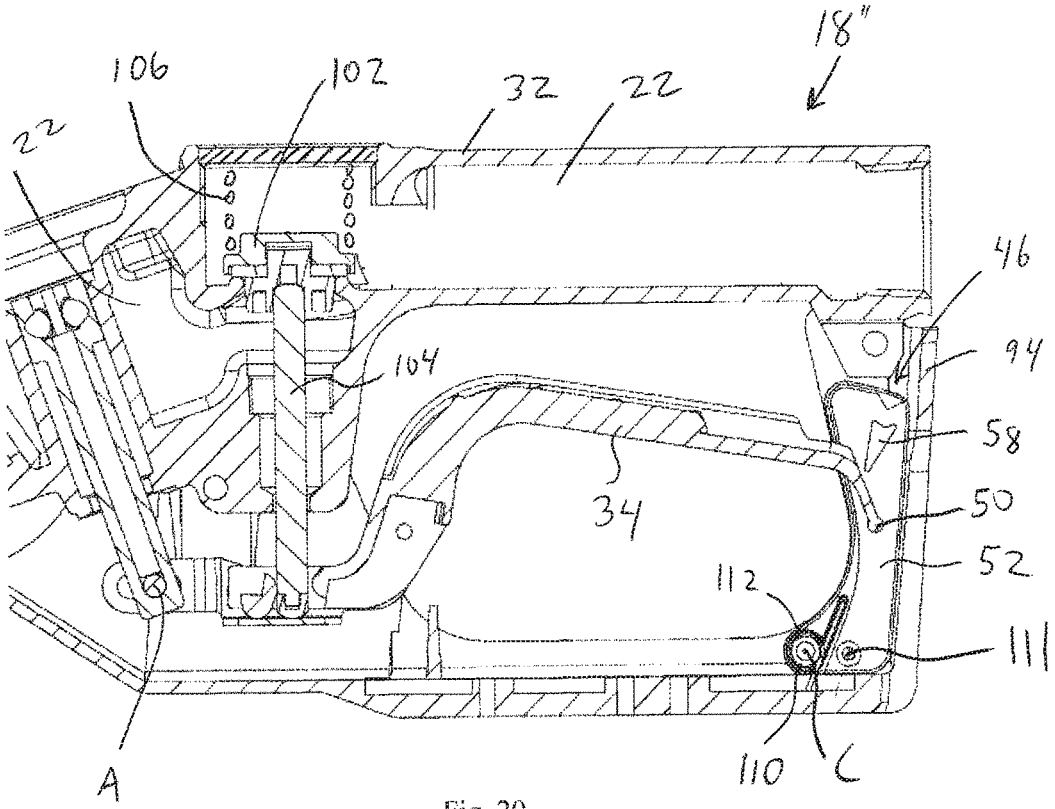
FIG. 20 is a partial cross section taken along line 20-20 of FIG. 19.

FIGS. 19-29 illustrate another embodiment of a nozzle 18". In this case the nozzle 18" includes the fluid path 22 through which fluid flows when the nozzle 18" dispenses fluid. The lever 34 can be operatively coupled to a valve (in one case, shown as valve 102 in FIG. 20) via a stem 104 positioned above and/or coupled to the lever 34. The lever 34 and/or valve 102 and/or stem 104 can be biased to a lower/closed position as shown in FIG. 20, such as by a valve spring 106. When a user desires to dispense fluid, the user can grasp and raise the lever 34, which in turn raises the stem 104 and opens the valve 102 to allow fluid to flow through the fluid path 22. When the user releases the lever 34, in the absence of any other force or device holding the lever 34 open, the lever 34 returns to its lower position due to the biasing of the lever 34 and/or valve 102 and or stem 104, blocking the flow of fluid through the fluid path 22. In the manner the lever 34 and/or operation of the lever 34 controls the flow of fluid through the nozzle 18", and therefore the dispensing operations of the nozzle 18".

The nozzle 18" can include a latch assembly 46 that operates on somewhat similar principles as the nozzle 18 and latch assembly 46 shown in FIGS. 1-9 and the nozzle 18' and latch assembly 46 shown in FIGS. 10-18 and described above. In the embodiment of FIGS. 19-29, the engagement surface 50 takes the form of a pin, or a cylindrical or elongated body or portion positioned at the distal end of the lever 34, in a similar manner to the embodiment of FIGS. 10-18. The engagement surface 50 extends generally parallel to the axis A and perpendicular to the central/longitudinal axis of the nozzle body 32.

A pair of oppositely-positioned cams 58 are carried on the latch body 52 that is pivotally coupled to the nozzle body 32 about axis C defined by pin 110. The latch body 52 is biased toward the rear of the nozzle body 32, i.e. in a clockwise direction with reference to FIG. 20, by a torsion spring 112 which is received about the pin 110 in the illustrated embodiment. The cams 58 and latch body 52 can be located near or incorporated into the hand guard 94 of the nozzle 18". FIGS. 20-29 illustrate a cam 58 and latch body 52 on one side of the nozzle body 32, and a second cam 58 and latch body 52 which engages the pin 50 can be positioned on the opposite side thereof, as shown in FIG. 19, where the cam bodies 52 are secured by a pin 111. The two latch bodies 52/cams 58 can be formed as two pieces joined together, or molded as a single, unitary seamless part. The engagement surface 50 can extend laterally outwardly from an end of the lever 34 to engage each cam 58.

Figure 22:
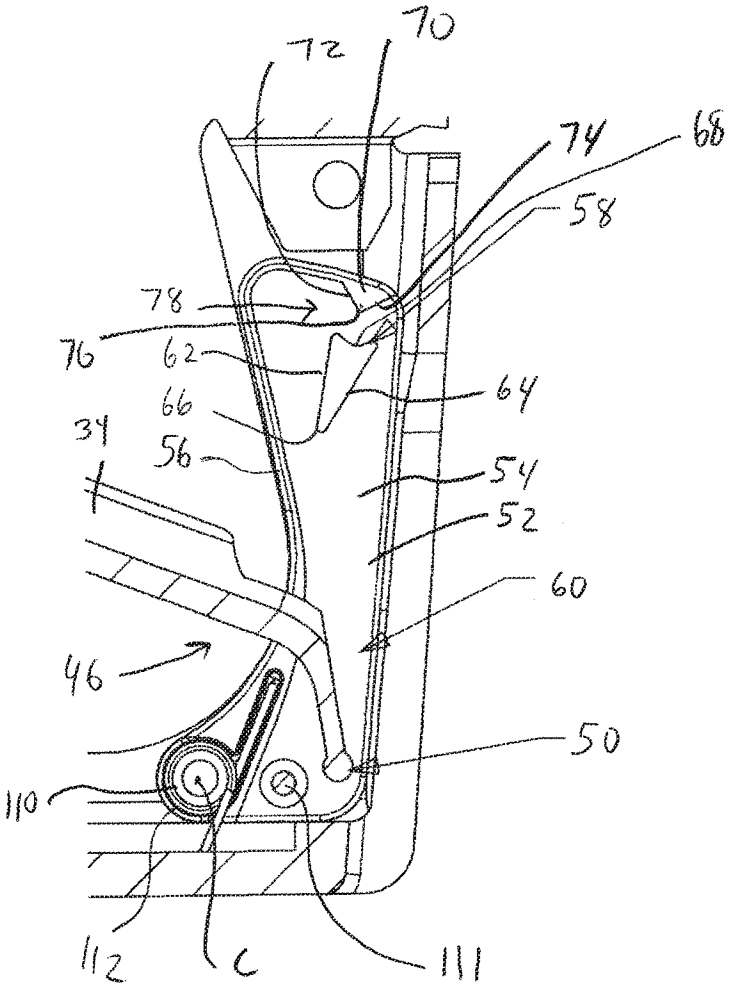
FIG. 22 is detail view of the latch assembly of the nozzle of FIG. 20, with the lever in its lower, non-dispensing position.
Figure 21:
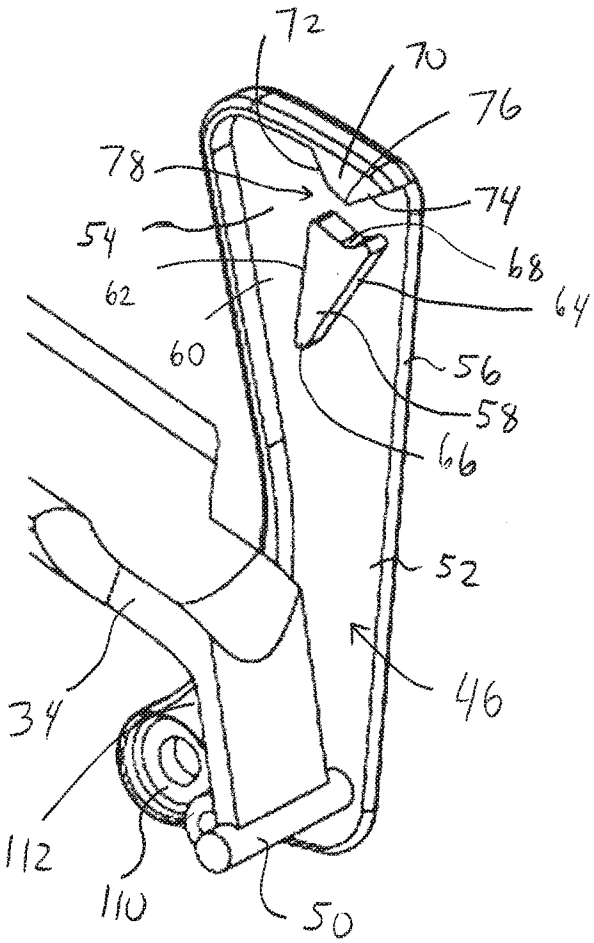
FIG. 21 is a front perspective view of the latch assembly of the nozzle of FIGS. 19 and 20, with the lever in its lower, non-dispensing position.
Figure 24:
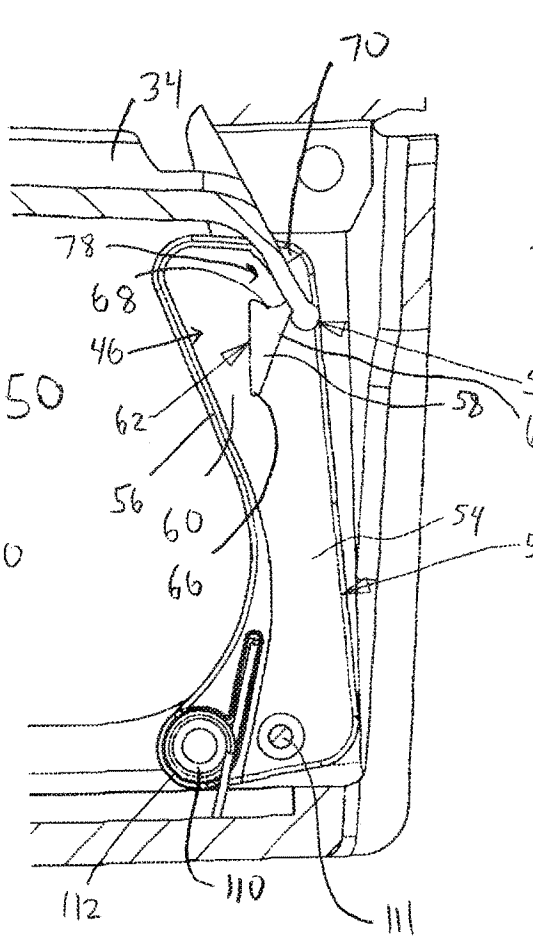
FIG. 24 shows the latch assembly of FIG. 23, with the lever raised from the position shown in FIG. 23.
Figure 23:
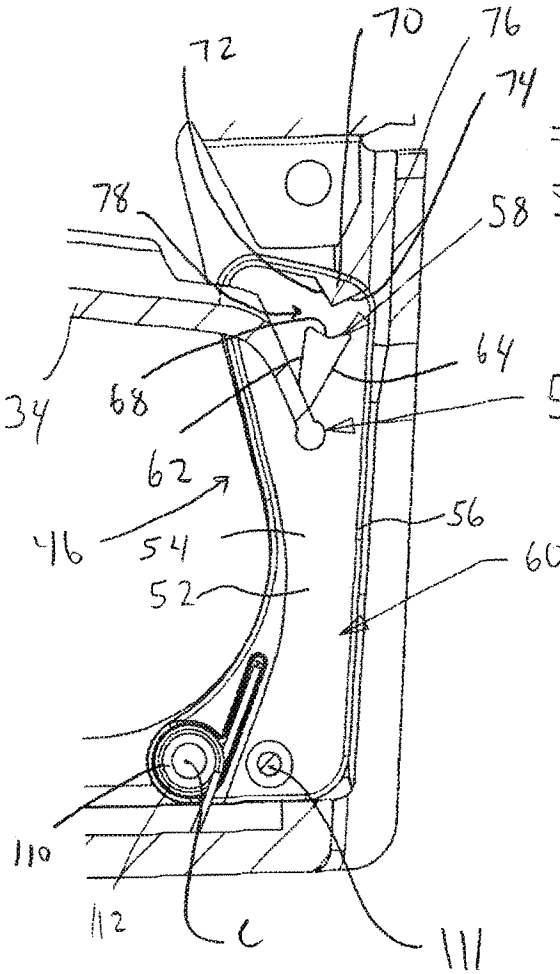
FIG. 23 shows the latch assembly of FIG. 22, with the lever raised from the position shown in FIG. 22 and beginning to engage the cam.

FIGS. 21 and 22 illustrate the nozzle 18" with the lever 34 and pin 50 in its lower, non-operating or non-dispensing home position. In order to operate the nozzle 18"/latch assembly 46 a user can grip, raise and pivot the lever 34 about its axis A (see FIG. 20). As the lever 34 is pivoted and swung in its arc the pin 50 moves upwardly sufficiently that the pin 50 engages the outer surface 64 of the cam 58, as shown in FIG. 23. Thus this embodiment is different from those described above where the pin 50 initially engages the inner surface 62 of the cam 58 and instead initially engages the outer surface 64. As the lever 34 and pin 50 continue to move on their arcuate path, up and to the left from the position shown in FIG. 23, the pin 50 pushes on the outer surface 64, thereby causing the cam 58 and latch body 52 to pivot about the cam body pivot point C (moving counter-clockwise in the illustrated embodiment as shown in FIG. 23), loading the torsion spring 112, as shown in FIG. 24.

Figure 25:
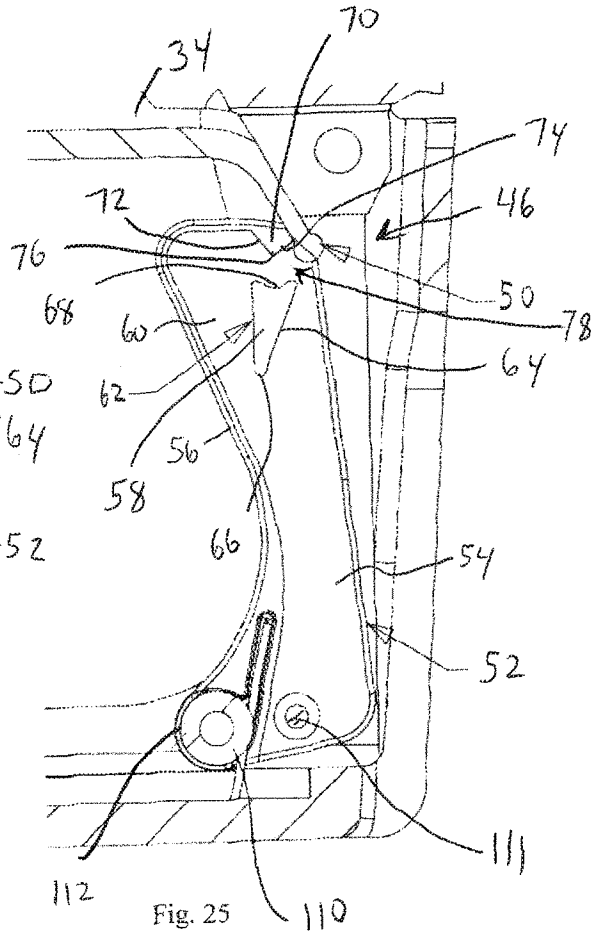
FIG. 25 shows the latch assembly of FIG. 24, with the lever raised from the position shown in FIG. 24.
Figure 27:
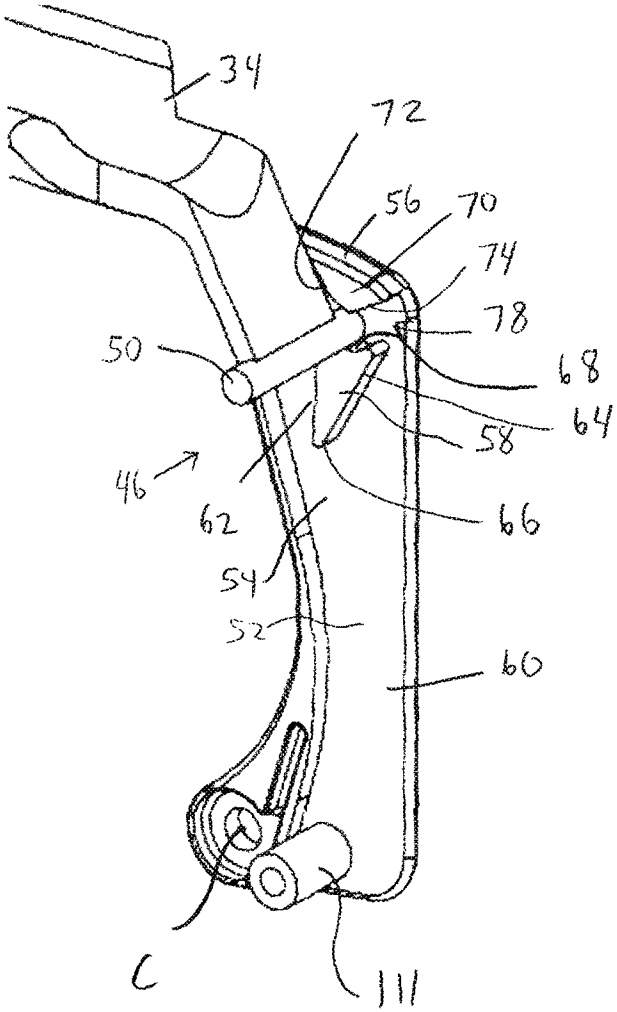
FIG. 27 is a side perspective view of the latch assembly of FIG. 26.
Figure 26:
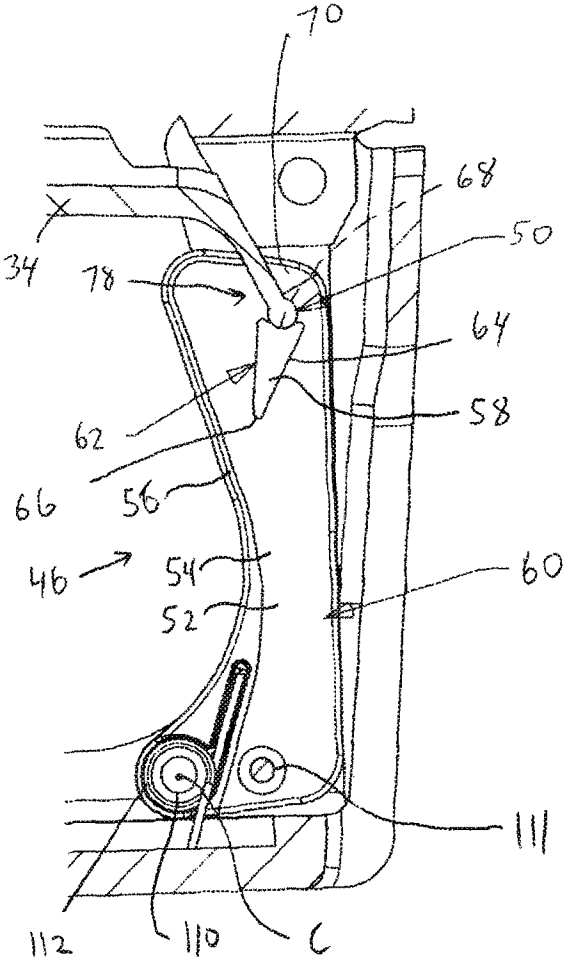
FIG. 26 shows the latch assembly of FIG. 25, with the lever slightly lowered and the nozzle retained in a dispensing position.
Figure 29:
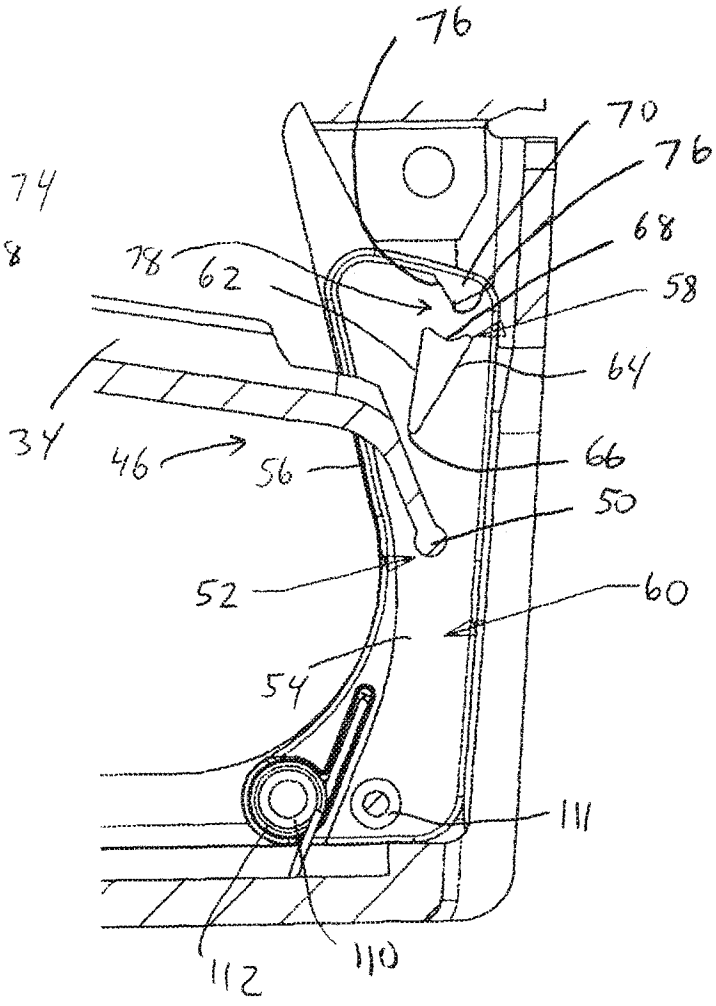
FIG. 29 shows the latch assembly of FIG. 28 with the lever slightly lowered from the position of FIG. 28 and clear of the cam.

As the lever 34 and pin 50 are continued to be raised, once the pin 50 clears the cam 58 and reaches the gap 78 the latch body 52 will begin to pivot from its inner position back toward its outer position, and the lever 34 will be blocked from being further raised when the pin 50 engages the guide 70, as shown in FIG. 25. The user can then begin to lower the lever 34, and the pin 50 will be guided into the recess 68 of the cam 58 by the outer surface 74 of the guide 70, as shown in FIGS. 26 and 27. Once the pin 50 is in the position shown in FIGS. 26 and 27, the pin 50 is stably held in position as it is cradled by the recess 68. The user can then completely manually release the lever 34, and the nozzle 18"/lever 34 will be maintained in the operating, latched or dispensing position shown in FIGS. 26 and 27. The spring 112 may continue to bias the latch body 52 clockwise when the nozzle 18"/lever 34 is in this position, but the bias force is not sufficient to overcome the seating of the pin 50 in the recess 68.

Figure 28:
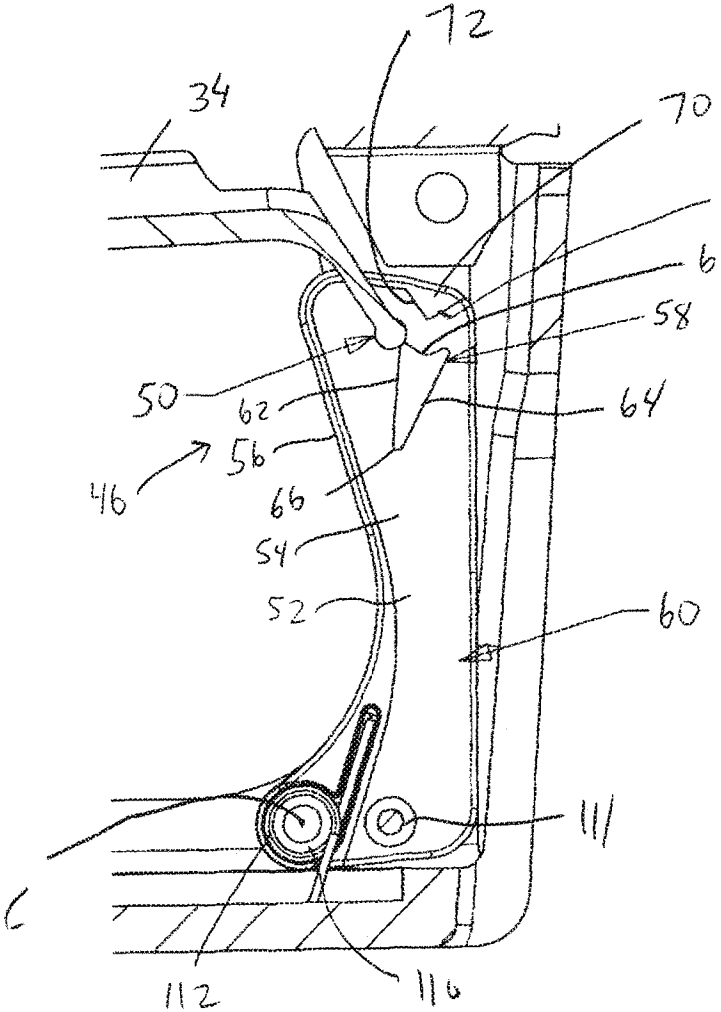
FIG. 28 shows the latch assembly of FIG. 27 with the lever slightly raised from the position of FIG. 27 and the latch body pivoted slightly outwardly.
Figure 30:
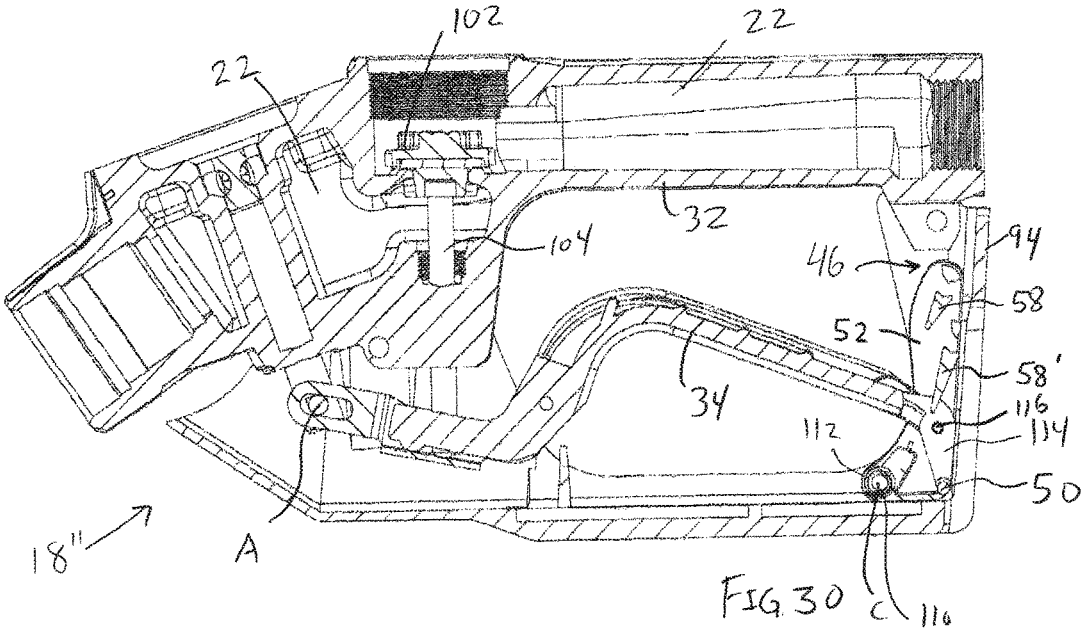
FIG. 30 is a side cross section of a variation of the nozzle of FIGS. 20-29, with the lever it its lower, non-dispensing position.

When it is desired to move the nozzle 18"/lever 34 out of the latched position, a user can grasp the lever 34 and raise the lever 34 slightly. Raising the lever 34 causes the pin 50 to engage the inner surface 72 of the guide 70 and enables the latch body 52 to pivot away from the pin 50 (clockwise in the illustrated embodiment), as biased by spring 112. The user can then release the lever 34 and/or guide the lever 34 downwardly as shown in FIG. 28. In this case the pin 50 can engage the inner surface 62 of the cam 58, urging the latch body 52 in the clockwise direction, in the opposite direction from the direction the latch body 52 was urged during initial actuation of the lever 34. Once the lever 34 is sufficiently lowered, the pin 50 clears the cam 58 (FIG. 29) and the cam 58 and latch body 52 are free to return to their neutral position, as shown in FIGS. 21 and 22.

In this embodiment of FIGS. 19-29 the position of the pin 50 and cam 58 can be reversed, and/or one or both of the pin 50 and cam 58 can be movable and cause displacement of the other, as described above in the context of the embodiments of FIGS. 1-9 and 10-18, respectively. In the embodiment of FIGS. 1-9 the latch body 52 is movable in a direction perpendicular to the pivot axis A of the lever 34, and initially moves rearwardly; in the embodiment of FIGS. 10-18 the latch body 52 is movable in a direction parallel to the pivot axis A of the lever 34 and initially moves laterally; in the embodiment of FIGS. 19-29 the latch body 52 is pivotable about an axis parallel to the pivot axis A of the lever 34. In addition, in all the differing embodiments the direction of movement of the latch body 52 can be adjusted as desired by adjusting the shape/positioning of the cam body 58, the shape/positioning of the engagement surface 50, etc. However, in some cases the latch body 52 is not pivotally about an axis extending perpendicular to the axis A of the lever 34, and/or is not pivotable about a vertical axis (i.e. is not pivotable about an axis extending vertically in FIGS. 12-20). In this case the latch body 52 and/or cam 58 is fixed relative to a vertical axis of the nozzle 18, 18', 18", or not pivotable about the vertical axis, wherein the vertical axis is aligned with or parallel to a plane D (FIG. 20) defined by a sweep of the lever 34 when the lever 34 pivots about axis A.

As shown in a variation of the nozzle 18" as shown in FIGS. 30-41, in some cases the latch body 52 can include the cam 58 described and shown in FIGS. 19-29, and also include a lower or supplemental cam 58' positioned thereon. In the illustrated embodiment the supplemental cam 58' is positioned below the cam 58 described and shown above. The supplemental cam 58' can be used to retain the lever 34 at a lower position compared to the cam 58 (e.g. retain the lever 34 in a supplemental operating or dispensing position), when fluid is desired to be disposed through the nozzle 18" at a lower flow rate. In some cases the fill pipe 26 of the tank 30 may be configured such that fluid cannot be dispensed into the tank 30 at the dispensing rate when the lever 34 is held open at by the cam 58, without causing spillage or automatic shut-off of the nozzle 18. The supplemental cam 58' thus provides an option to dispense fluid at a lower dispensing rate.

Figure 31:
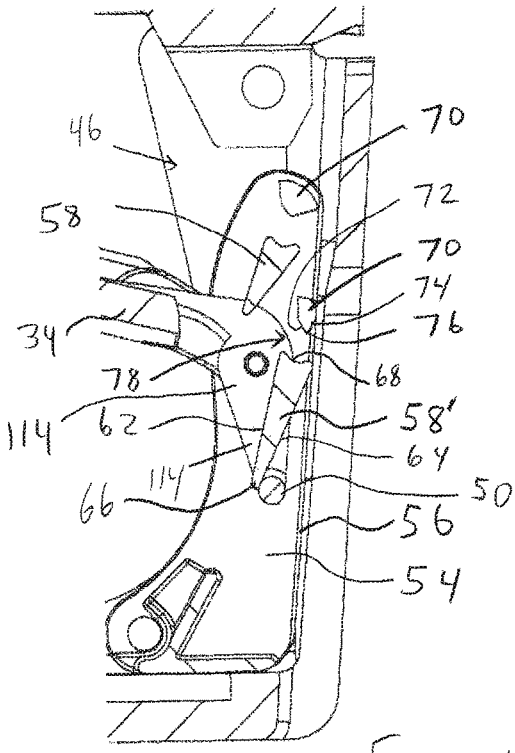
FIG. 31 is a detail view of the latch assembly of the nozzle of FIG. 30, with the lever raised from the position shown in FIG. 30 and beginning the engage the lower cam.
Figure 34:
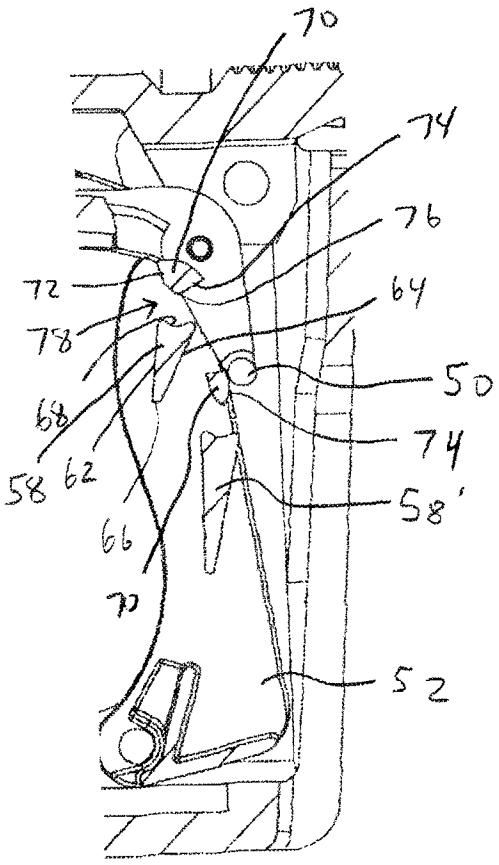
FIGS. 32-41 are a series of detail views of the latch assembly of FIG. 30, showing how the cams can be utilized.
Figure 33:
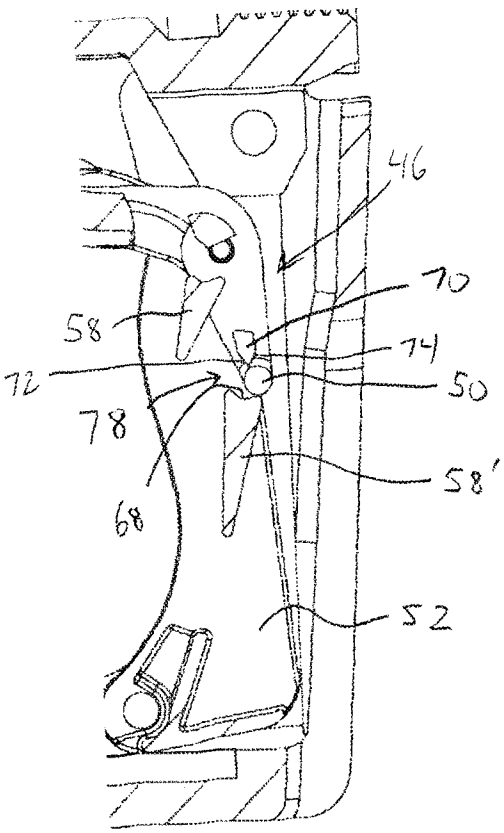
Figure 32:
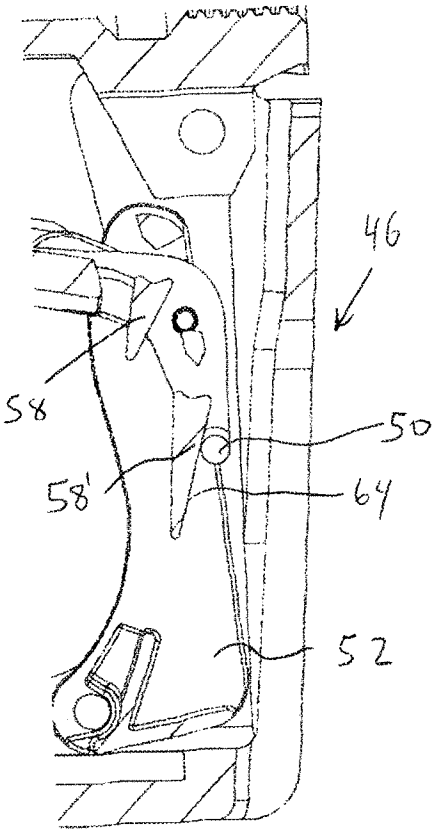
Figure 38:
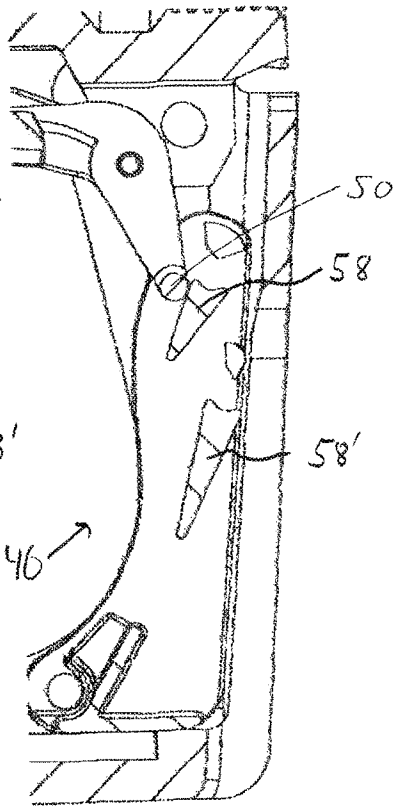
Figure 37:
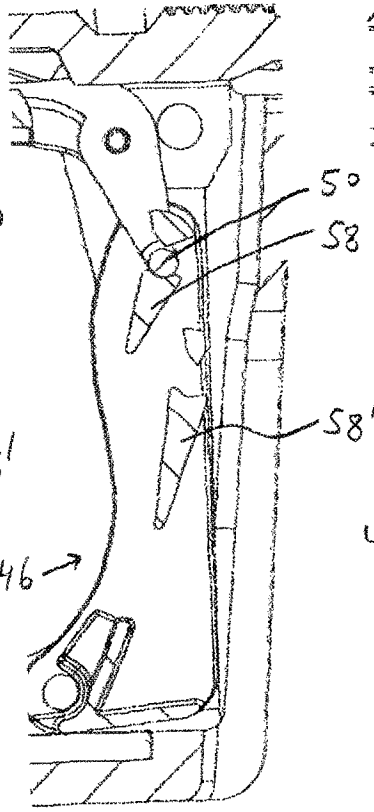
Figure 36:
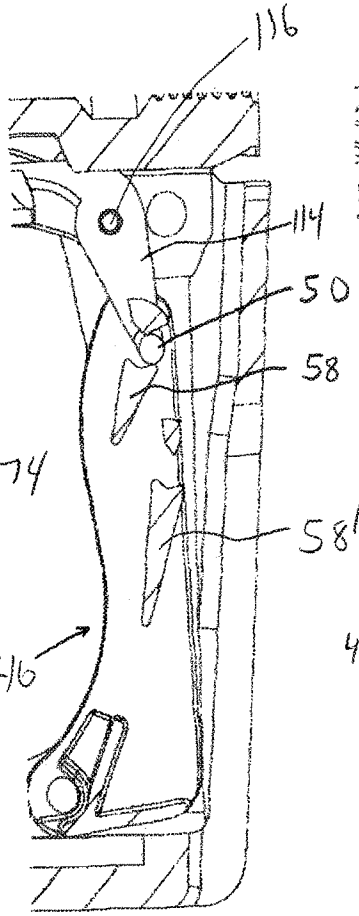
Figure 35:
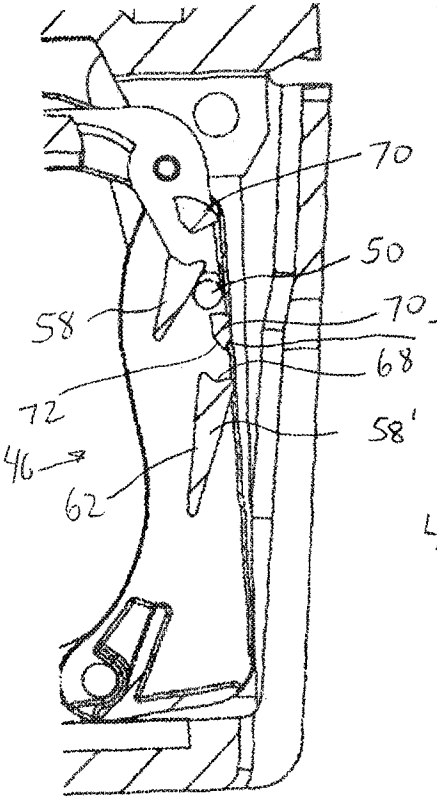

When a user desires to utilize the nozzle 18" of FIGS. 30-41, the lever 34 can be raised/actuated such that the pin 50 engages the outer surface 64 of the cam 58' as shown in FIG. 31, and rides up along the outer surface 64 as shown in FIG. 32. As the lever 34 is continued to be raised the pin 50 is positioned in the gap 78 of the cam 58' as shown in FIG. 33. At this point the user may hear and/or feel the pin 50 as it clears the outer surface 64 and is positioned in the gap 78 of the lower cam 58'. If it is desired to utilized the lower cam 58' the user may at this point lower the lever 34, which causes the pin 50 to be received in the recess 68 of the lower cam 58'. The lever 34 can then be operated in conjunction with the lower cam 58' in the same manner as the upper cam 58 described above, i.e. retained in the recess 68 during dispensing. When the pin 50 is raised out of the recess 68 of the lower cam 58', the pin 50 can engage the inner surface 72 of the guide 70 of the lower cam 58', and be positioned as shown in FIG. 35.

Figure 40:
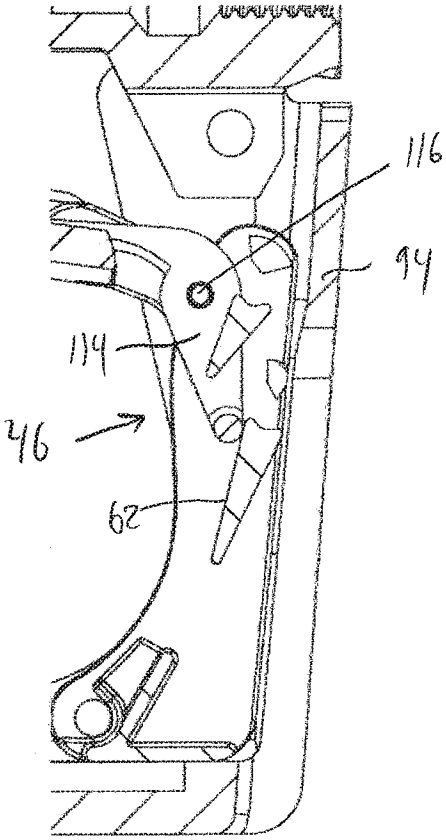

In contrast, from the position of FIG. 33, if the lever 34 is raised instead of lowered, the pin 50 slides along the outer surface 74 of the guide 70 of the lower cam 58'. As the lever 34 is further raised the pin 50 clears the guide 70 of the lower cam 58' and is positioned as shown in FIG. 35. From the position shown in FIG. 35, if the lever 34 is raised the upper cam 58 can be used to retain the lever 34 in the manner described above in the embodiment of FIGS. 19-29 and shown in FIGS. 36-39. From the position of either FIG. 35 or FIG. 39, if the lever 34 is lowered the pin 50 engages the inner surface 62 of the lower cam 58', as shown in FIG. 40. Further lowering of the lever 34 causes the pin 50 to slide along the inner surface 62 as shown in FIG. 41, before the latch assembly 46 returns to its position shown in FIG. 30.

Thus when the supplemental cam 58' is utilized it can operate in the same or similar manner as the cam 58, wherein the lever 34 can be raised and released to maintain the lever 34 in a dispensing position, and again raised and released to lower the lever 34, and the pin 50 forms a closed loop around the supplemental cam 58'. If desired, additional cams beyond those shown can be provided to offer additional retained positions for the lever 34. In addition, the embodiments of FIGS. 1-9 and 10-19 can also use a supplemental cam in the same or a similar manner if, for example, the nozzles 18, 18' and the valves 36 and 86, 88, 92 are properly arranged.

Figure 41:
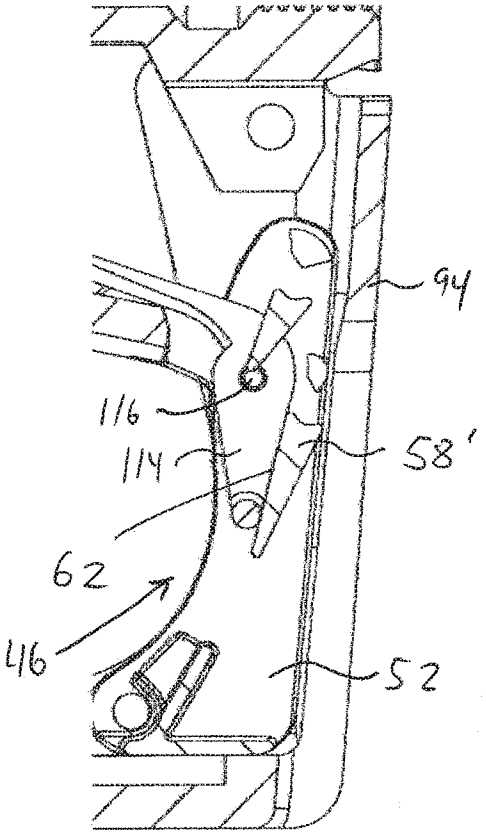
Figure 39:
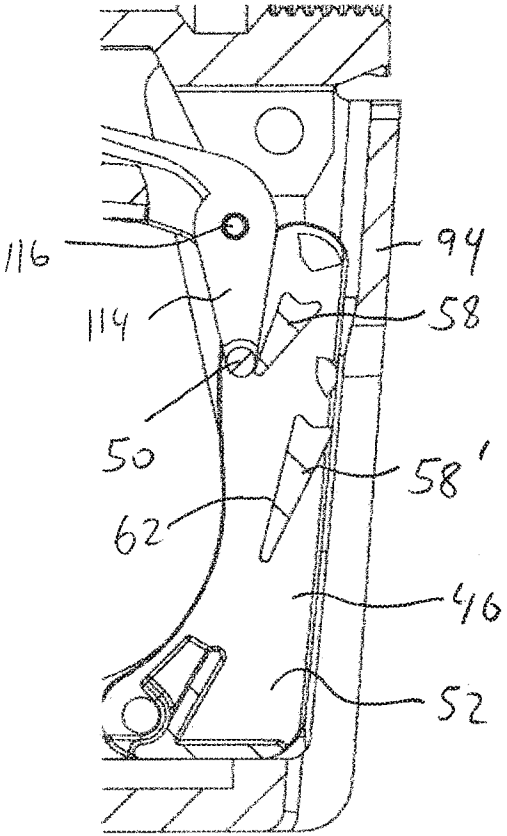

As shown in the embodiment of FIGS. 30-41, in some cases a lever extension 114 can be provided and pivotally coupled to the lever 34 at pivot point 116, where the lever extension 114 carries the pin 50 at its distal end thereof. The lever extension 114 can be spring biased away from the lever 34 and/or toward the latch body 52 (e.g. the pin 50 can be biased in a counterclockwise direction about pivot point 116 shown in FIG. 30). The lever extension 114 can be pivotable relative to the lever 34 about an axis parallel to the axis of rotation A of the lever 34. The biased and independently movable nature of the lever extension 114 helps to ensure the pin 50 moves in the desired path during dispensing operations. In particular the lever extension 114 can be seen to be pivoted about the pivot point 116, in the clockwise direction, in FIGS. 39 and 41 compared to, for example, FIG. 40. The lever extension 114 enables the pin 50 to pivot away from the cams 58, 58' when the lever 34 is slid along the cams 58, 58' and the latch body 52 is blocked from pivoting in the clockwise direction due to engagement with the hand guard 94, to enable the lever 34 to be lowered.

Thus, it can be seen that the latch assembly/assemblies 46 disclosed herein provides an intuitive system that is easy to operate. In each case a user need only operate/raise the lever 34 to its maximum permitted extent and release the lever 34, and the latch assembly 46 is automatically actuated such that the lever 34 is automatically retained in its dispensing position without requiring any other operations by the user. When it is desired to release the lever 34, the lever 34 is simply grasped and again raised slightly to its maximum extent and then released. The latch assembly 46 is released automatically and the lever 34 can be lowered to its home or non-dispensing position without requiring any other operations by the user. The latch assemblies 46 are also robust and relatively easy to manufacture and install.

Having described the invention in detail and by reference to the various embodiments, it should be understood that modifications and variations thereof are possible without departing from the scope of the claims of the present application.

What is claimed is:

1. A nozzle system comprising:

a nozzle body configured to dispense fluid therethrough;

a lever coupled to said nozzle body and movable in a lever plane between a non-operating position and an operating position; and a latch assembly including:

an engagement surface; and a cam, wherein said cam is coupled to or positioned on one of said nozzle body or said lever and said engagement surface is coupled to or positioned on the other one of said nozzle body or said lever, wherein the nozzle system is configured such that when said lever is moved from said non-operating position to said operating position, said engagement surface engages said cam to cause at least one of said engagement surface or said cam to move relative to the other such that said lever is automatically retainable in said operating position by said latch assembly, wherein said cam does not pivot about an axis aligned with said lever plane when said lever is moved from one of said non-operating position or said operating position to the other one of said non-operating position or said operating position, and wherein said latch assembly is configured such when said lever is moved from said non-operating position to said operating position and from said operating position back to said non-operating position, said engagement surface moves relative to said cam to form a non-linear closed loop.

2. The nozzle system of claim 1 wherein said cam at least partially defines a generally heart-shaped path through which said engagement surface is guided when said lever is moved from said non-operating position to said operating position, and from said operating position to said non-operating position.

3. The nozzle of claim 1 wherein said lever is movable from said non-operating position to a position in which said latch assembly automatically retains said lever in said operating position by raising said lever to a hard stop position and then releasing said lever, and wherein said lever is movable from said position in which said latch assembly automatically retains said lever to said non-operating position by raising said lever to a hard stop and then releasing said lever.

4. The nozzle system of claim 1 wherein said cam includes a curved or angled surface, wherein said engagement surface is configured to engage said curved or angled surface to thereby move said at least one of said cam or said engagement surface when said lever is moved from said one of said non-operating position and said operating position to the other one of said non-operating position and said operating position.

5. The nozzle system of claim 4 wherein said cam includes a supplemental curved or angled surface at least partially spaced away from said curved or angled surface, and wherein said engagement surface is configured to engage said supplemental curved or angled surface to thereby move said at least one of said cam or said engagement surface when said lever is moved from said other one of said non-operating position and said operating position to said one of said non-operating position and said operating position.

6. The nozzle system of claim 1 wherein said cam defines a recessed path configured to receive said engagement surface therein, and wherein said recessed path is generally flat and planar.

7. The nozzle system of claim 1 said lever is pivotable in said lever plane between said operating position and said non-operating position, and wherein said cam includes a surface, configured to be engaged by said engagement surface, that is curved or angled in a plane that is parallel to said lever plane.

8. The nozzle system of claim 1 said lever is pivotable in said lever plane between said operating position and said non-operating position, and wherein said cam includes a surface, configured to be engaged by said engagement surface, that is curved or angled in a plane that is perpendicular to said lever plane.

9. The nozzle system of claim 1 wherein said cam includes a recessed area configured to receive said engagement surface therein to retain said lever in a retained position which is also said operating position.

10. The nozzle system of claim 9 wherein said latch assembly further includes a guide surface positioned generally opposite said recessed area and configured to guide said engagement surface toward said recessed area when said lever is moved to said retained position.

11. The nozzle system of claim 9 wherein said latch assembly further includes a guide surface positioned generally opposite said recessed area and configured to guide said engagement surface away from said recessed area when said lever is moved away from said retained position.

12. The nozzle system of claim 1 wherein said lever is pivotable about a lever axis between said operating position and said non-operating position, and wherein at least one of said cam or said engagement surface is movable relative to the other in a direction perpendicular to said lever axis.

13. The nozzle system of claim 1 wherein said lever is pivotable about a lever axis between said operating position and said non-operating position, and wherein at least one of said cam or said engagement surface is movable relative to the other in a direction parallel to said lever axis.

14. The nozzle system of claim 1 wherein said lever is pivotable about a lever axis between said operating position and said non-operating position, and wherein at least one of said cam or said engagement surface is pivotable about a pivot axis parallel to said lever axis.

15. The nozzle system of claim 1 wherein at least one of said cam or said engagement surface is biased into a neutral position, and wherein said latch assembly is configured that movement of said lever from one of said non-operating position and said operating position to the other one of said non-operating position and said operating position causes said at least one of said cam or said engagement surface that is biased to move away from said neutral position.

16. The nozzle system of claim 15 wherein said at least one of said cam or said engagement surface is biased to be in said neutral position when said lever is in said non-operating position.

17. The nozzle system of claim 1 wherein said lever is pivotable about a lever axis between said operating position and said non-operating position, and wherein said engagement surface is a pin directly coupled to or carried on said lever and spaced away from a distal end of said lever relative to said lever axis.

18. The nozzle system of claim 1 wherein said lever is pivotable about a lever axis between said operating position and said non-operating position, and wherein said engagement surface forms or is coupled to a distal end of said lever relative to said lever axis.

19. The nozzle system of claim 1 wherein said nozzle is configured such that when said lever is in said operating position fluid is flowable through said nozzle and when said lever is in said non-operating position fluid is blocked from flowing through said nozzle.

20. The nozzle system of claim 1 wherein said lever is movable to a supplemental operating position, wherein the latch assembly includes a supplemental cam coupled to or positioned on one of said nozzle body or said lever, and wherein the nozzle system is configured such that when said lever is moved from said non-operating position to said supplemental operating position, said engagement surface engages said supplemental cam to cause at least one of said engagement surface or said supplemental cam to move relative to the other such that said lever is automatically retainable in said supplemental operating position by said latch assembly.

21. The nozzle system of claim 20 wherein said engagement surface is coupled to said lever and is pivotable relative to said lever about an axis parallel to a lever axis about which said lever is pivotable.

22. The nozzle system of claim 1 said cam is not pivotable about an axis parallel with said lever plane.

23. A nozzle system comprising:

a nozzle body configured to dispense fluid therethrough;

a lever coupled to said nozzle body and movable in a lever plane between a non-operating position and an operating position; and a latch assembly configured such that when said lever is moved from said non-operating position to said operating position, said lever is automatically retainable in said operating position by said latch assembly, and wherein said latch assembly is configured such that when said lever is in said operating position and is further actuated, said lever is automatically released to enable said lever to return to said non-operating position, wherein said latch assembly includes:

an engagement surface; and a cam including a recessed portion configured to receive said engagement surface therein, wherein the latch assembly is configured such that when said lever is moved from said non-operating position to said operating position, said engagement surface engages said cam to cause at least one of said engagement surface or said cam to move relative to the other, wherein said recessed portion is generally flat and planar and positioned on an upper-most surface of said cam when said nozzle body is in a dispensing position.

24. A nozzle system comprising:

a nozzle body configured to dispense fluid therethrough;

a lever coupled to said nozzle body and movable in a first direction between a non-operating position and an operating position; and a latch assembly including:

an engagement surface coupled to or positioned on said lever; and a cam coupled to or positioned on said nozzle body, said cam including a curved or angled surface and a recess wherein the nozzle system is configured such that when said lever is moved from said non-operating position to said operating position said engagement surface engages said curved or angled surface of said cam to cause said cam to move relative to the nozzle body, wherein sufficient movement of said lever in said first direction causes said lever to move beyond and no longer contact said curved or angled surface, after which movement of said lever in a second direction opposite to said first direction causes said engagement surface to engage and be retainable in said recess, and wherein said nozzle system is configured such that further movement of said lever when said engagement surface is in said recess enables said lever to return to said non-operating position without said engagement surface contacting said curved or angled surface of said cam.

25. A method for operating a nozzle system comprising:

accessing a nozzle system including a nozzle body configured to dispense fluid therethrough, a lever coupled to said nozzle body and movable between a non-operating position and an operating position, and a latch assembly including an engagement surface and a cam, wherein said cam is coupled to or positioned on one of said nozzle body or said lever and said engagement surface is coupled to or positioned on the other one of said nozzle body or said lever;

moving said lever from said non-operating position to said operating position in a lever plane, which causes said engagement surface to engage said cam to cause at least one of said engagement surface or said cam to move relative to the other such that said latch assembly automatically retains said lever in said operating position, wherein said cam does not pivot about an axis aligned with said lever plane when said lever is moved from said non-operating position to said operating position; and moving or allowing said lever to move from said operating position to said non-operating position, and wherein when said lever is moved from said non-operating position to said operating position and from said operating position back to said non-operating position, said engagement surface moves relative to said cam to form a non-linear closed loop.

26. The system of claim 1 wherein said engagement surface is configured to move relative to said cam to form said non-linear closed loop with said cam positioned inside said loop.

27. The system of claim 1 wherein said engagement surface is configured to move relative to said cam to form said non-linear closed loop which is a closed loop shape that is not a straight line, or a curved line or an irregular line.

* * * * *